US010571834B2

(12) United States Patent
Matsuda et al.

(10) Patent No.: US 10,571,834 B2
(45) Date of Patent: Feb. 25, 2020

(54) FIXING METHOD, IMAGE FORMING METHOD, AND IMAGE FORMING APPARATUS

(71) Applicants: Ryohei Matsuda, Kanagawa (JP); Takamasa Hase, Tokyo (JP); Daisuke Inoue, Tokyo (JP); Teppei Kawata, Kanagawa (JP); Akio Takei, Shizuoka (JP)

(72) Inventors: Ryohei Matsuda, Kanagawa (JP); Takamasa Hase, Tokyo (JP); Daisuke Inoue, Tokyo (JP); Teppei Kawata, Kanagawa (JP); Akio Takei, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/266,149

(22) Filed: Feb. 4, 2019

(65) Prior Publication Data

US 2019/0243291 A1 Aug. 8, 2019

(30) Foreign Application Priority Data

Feb. 6, 2018 (JP) ..... 2018-019559

(51) Int. Cl.
*G03G 15/20* (2006.01)
*G03G 9/08* (2006.01)
*G03G 9/087* (2006.01)

(52) U.S. Cl.
CPC ..... *G03G 15/2025* (2013.01); *G03G 9/0821* (2013.01); *G03G 9/0825* (2013.01);
(Continued)

(58) Field of Classification Search
CPC ..... G03G 15/2025; G03G 15/2053; G03G 15/2064; G03G 9/08755; G03G 9/08797;
(Continued)

(56) References Cited

U.S. PATENT DOCUMENTS

2005/0026064 A1 2/2005 Sugiura et al.
2005/0141932 A1* 6/2005 Sugiyama ..... G03G 15/2064 399/328

(Continued)

FOREIGN PATENT DOCUMENTS

EP 1 591 838 A1 11/2005
JP 2004-246345 A 9/2004

(Continued)

OTHER PUBLICATIONS

Extended European Search Report dated Jun. 6, 2019 in Patent Application No. 19155054.0, 7 pages.

*Primary Examiner* — Sophia S Chen
(74) *Attorney, Agent, or Firm* — Oblon, McClelland, Maier & Neustadt, L.L.P.

(57) ABSTRACT

A fixing method is provided including the step of fixing a toner on a recording medium with a fixing device. The toner has a binder resin, a colorant, and a release agent, and has a release agent amount indicator of from 0.01 to 0.20. The release agent amount indicator is represented by a ratio ($P_{2850}/P_{828}$) of an intensity ($P_{2850}$) at a wave number of 2,850 $cm^{-1}$ to an intensity ($P_{828}$) at a wave number of 828 $cm^{-1}$ of the toner measured by a Fourier transform infrared spectroscopy attenuated total reflection method. The fixing device includes a fixing rotator driven to rotate by a driving source, a pressure rotator driven to rotate by rotation of the fixing rotator, a fixing belt interposed between the fixing rotator and the pressure rotator, and a heater to heat the fixing belt.

10 Claims, 6 Drawing Sheets

(52) U.S. Cl.
CPC ..... *G03G 9/08755* (2013.01); *G03G 9/08782* (2013.01); *G03G 9/08795* (2013.01); *G03G 9/08797* (2013.01); *G03G 15/2064* (2013.01)

(58) Field of Classification Search
CPC ..... G03G 9/0825; G03G 9/08795; G03G 9/0821; G03G 9/08782
See application file for complete search history.

(56) References Cited

U.S. PATENT DOCUMENTS

| | | | | |
|---|---|---|---|---|
| 2006/0056888 | A1 | 3/2006 | Sugiyama et al. | |
| 2006/0057488 | A1 | 3/2006 | Inoue et al. | |
| 2009/0162780 | A1 | 6/2009 | Yamashita et al. | |
| 2009/0180792 | A1* | 7/2009 | Hayamizu ..... | G03G 15/2032 399/67 |
| 2011/0065033 | A1 | 3/2011 | Uchinokura et al. | |
| 2012/0295193 | A1 | 11/2012 | Hanatani et al. | |
| 2013/0157193 | A1 | 6/2013 | Moritani et al. | |
| 2014/0363184 | A1* | 12/2014 | Santo ..... | G03G 9/08755 399/68 |
| 2015/0378272 | A1 | 12/2015 | Hase et al. | |
| 2017/0255147 | A1 | 9/2017 | Seki et al. | |
| 2017/0261900 | A1 | 9/2017 | Sawada et al. | |
| 2017/0277091 | A1 | 9/2017 | Uchitani et al. | |
| 2017/0285542 | A1 | 10/2017 | Hase et al. | |
| 2017/0357198 | A1 | 12/2017 | Namekata et al. | |
| 2018/0011432 | A1 | 1/2018 | Yoshinaga et al. | |
| 2018/0024452 | A1 | 1/2018 | Sugimoto et al. | |
| 2018/0088502 | A1 | 3/2018 | Sugiyama et al. | |
| 2018/0157198 | A1 | 6/2018 | Seto et al. | |
| 2018/0284663 | A1 | 10/2018 | Matsuda et al. | |
| 2018/0335733 | A1 | 11/2018 | Matsuda et al. | |
| 2018/0348680 | A1 | 12/2018 | Fujimoto et al. | |
| 2018/0356754 | A1 | 12/2018 | Yoshinaga et al. | |
| 2019/0011864 | A1 | 1/2019 | Kawata et al. | |
| 2019/0018348 | A1 | 1/2019 | Watanabe et al. | |
| 2019/0018351 | A1 | 1/2019 | Hirose et al. | |

FOREIGN PATENT DOCUMENTS

| | | |
|---|---|---|
| JP | 2011-133518 A | 7/2011 |
| JP | 2012-083714 | 4/2012 |
| JP | 2016-180792 | 10/2016 |
| JP | 2017-116908 | 6/2017 |

* cited by examiner

FIXING METHOD, IMAGE FORMING METHOD, AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2018-019559, filed on Feb. 6, 2018, in the Japan Patent Office, the entire disclosure of which is hereby incorporated by reference herein.

BACKGROUND

Technical Field

The present disclosure relates to a fixing method, an image forming method, and an image forming apparatus.

Description of the Related Art

An electrophotographic method generally includes the processes of forming an electrostatic latent image on a photoconductor, developing the electrostatic latent image with a developer to form a toner image, transferring the toner image onto a recording medium such as paper, and fixing the toner image on the recording medium by heat, pressure, a solvent gas, or the like, to obtain an image. Specifically, an unfixed toner image on the photoconductor is transferred onto a recording medium such as paper is guided between a fixing rotator and a pressure rotator to be heated and pressed, thereby fixing the toner image on the recording medium. There is a known technique of containing a release agent such as wax in the toner to prevent the recording medium from winding around the fixing rotator, that is, a technique of enhancing releasability of the toner in the fixing process (hereinafter "fixing releasability").

When a toner image containing wax as a release agent is fixed on a recording medium, the wax exudes on the surface of the fixed toner image and a latent image is formed with the wax on the surface of the fixing rotator. When another toner image is thereafter fixed on the next recording medium, a glossy residual image undesirably appears in the fixed toner image since the surface of the fixing rotator has a portion with a large amount of wax attached and another portion with a small amount of wax attached.

SUMMARY

In accordance with some embodiments of the present invention, a fixing method is provided including the step of fixing a toner on a recording medium with a fixing device. The toner comprises a binder resin, a colorant, and a release agent, and has a release agent amount indicator of from 0.01 to 0.20. The release agent amount indicator is represented by a ratio ($P_{2850}/P_{828}$) of an intensity ($P_{2850}$) at a wave number of 2,850 $cm^{-1}$ to an intensity ($P_{828}$) at a wave number of 828 $cm^{-1}$ of the toner measured by a Fourier transform infrared spectroscopy attenuated total reflection method. The fixing device includes a fixing rotator driven to rotate by a driving source, a pressure rotator driven to rotate by rotation of the fixing rotator, a fixing belt interposed between the fixing rotator and the pressure rotator, and a heater to heat the fixing belt.

In accordance with some embodiments of the present invention, an image forming method is provided including the steps of forming an image with the above-described toner and fixing the image on a recording medium with the above-described fixing device.

In accordance with some embodiments of the present invention, an image forming apparatus is provided. The image forming apparatus includes an electrostatic latent image bearer; a charger to charge a surface of the electrostatic latent image bearer; an irradiator to irradiate the charged surface of the electrostatic latent image bearer to form an electrostatic latent image; a developing device containing the above-described toner, to develop the electrostatic latent image with the toner to form a toner image; a transfer device to transfer the toner image onto a recording medium; and the above-described fixing device to fix the toner image on the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
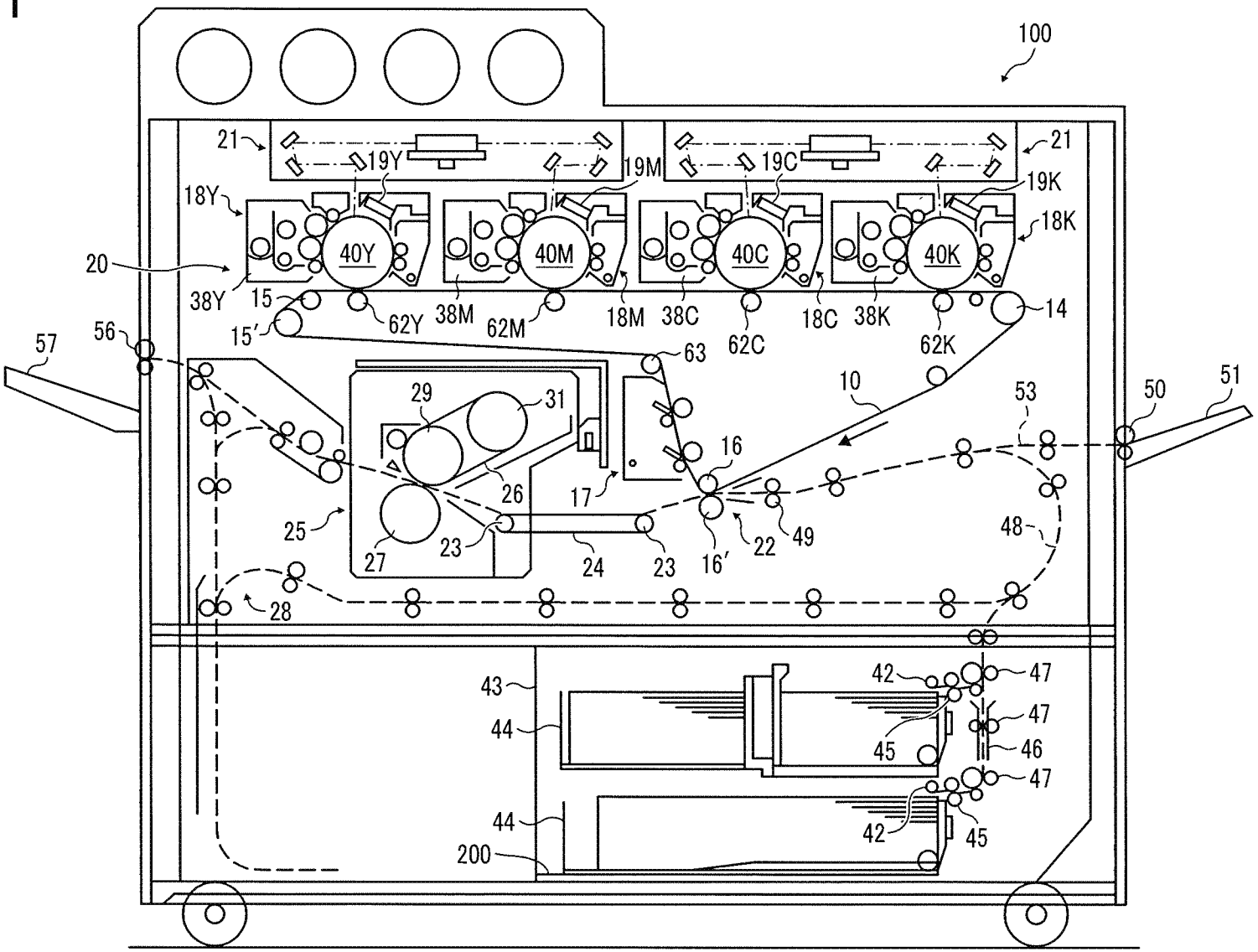
FIG. 1 is a schematic view of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

According to an embodiment of the present invention, a fixing method capable of suppressing the occurrence of glossy residual image while maintaining fixing releasability is provided.

Embodiments of the present invention are described in detail below with reference to the drawings.

In attempting to solve the above-described problems, the inventors of the present invention have found that the occurrence of glossy residual image can be suppressed by adjusting the amount of wax exuding from the toner at the time of fixing the toner image, by combining a specific fixing method and a specific toner in which the amount of wax on the surface is adjusted. More specifically, the shear force applied to the fixing nip is small when the fixing rotator is the main drive. Since the shear force acts as a force for separating the wax exuding on the surface of the toner from the toner, the wax is suppressed from excessively transferring to the fixing rotator when the shear force is small. In addition, the dispersion state of the release agent in the toner is adjusted such that the occurrence of glossy residual image is suppressed while fixing releasability is maintained in a case in which the fixing rotator is the main drive.

FIG. 1 is a schematic view of an image forming apparatus according to an embodiment of the present invention.

An image forming apparatus illustrated in FIG. 1 includes an apparatus main body 100 and a sheet feeding table 200 disposed at a lower portion of the apparatus main body 100.

In the apparatus main body 100, four image forming units 18Y, 18M, 18C, and 18K (hereinafter may be abbreviated as "18Y-K") are disposed side by side, forming a tandem image forming unit 20. The suffixes Y, M, C, and K attached to the reference numerals of the image forming units 18Y, 18M, 18C, and 18K represent yellow, magenta, cyan, and black, respectively.

The image forming units 18Y, 18M, 18C, and 18K have respective drum-shaped photoconductors 40Y, 40M, 40C, and 40K (hereinafter may be abbreviated as "40Y-K") serving as electrostatic latent image bearers that carry toner images of respective colors of Y, M, C, and K.

Since the image forming units 18Y-K have the same configuration, only the image forming units 18Y-K and the photoconductors 40Y-K are denoted by suffixes indicating the color of the toner.

Below the tandem image forming unit 20 and at the center of the apparatus main body 100, an intermediate transfer belt 10 in the form of an endless belt is disposed as an intermediate transfer medium. The intermediate transfer belt 10 is wound around a plurality of support rollers 14, 15, 15', 16, and 63 and is rotatable clockwise in FIG. 1. Referring to FIG. 1, a cleaner 17 for cleaning the intermediate transfer belt 10 is disposed on the left side of the support roller 16. The cleaner 17 removes residual toner remaining on the intermediate transfer belt 10 after a toner image is transferred therefrom.

Above the intermediate transfer belt 10 stretched between the support roller 14 and the support roller 15, the above-described four image forming units 18Y-K are arranged side by side along the direction of conveyance of the intermediate transfer belt 10, forming the tandem image forming unit 20.

Above the tandem image forming unit 20, two irradiators 21 are disposed. One of the irradiators 21 corresponds to the two image forming units 18Y and 18M and the other corresponds to the two image forming units 18C and 18K. Each of the irradiators 21 may be an optical scanning irradiator containing two light source devices (e.g., a semiconductor laser, a semiconductor laser array, a multibeam light source) and coupling optical systems, a common optical deflector (e.g., a polygon mirror), and two scanning imaging optical systems. The irradiators 21 irradiate the surfaces of the photoconductors 40Y-K with light in accordance with image information of respective colors of yellow, cyan, magenta, and black to form electrostatic latent images.

Around each of the photoconductors 40Y-K in the respective image forming units 18Y-K, a charger 19Y, 19M, 19C, or 19K for uniformly charging the photoconductor prior to the irradiation of light, a developing device 38Y, 38M, 38C, or 38K for developing an electrostatic latent image formed by the irradiator 21 with each color toner, and a photoconductor cleaner for removing residual toner remaining on the photoconductor without being transferred are disposed.

At each primary transfer position where the toner image is transferred from each of the photoconductors 40Y-K to the intermediate transfer belt 10, a primary transfer roller 62, as a component of a primary transfer device, is disposed facing each of the photoconductors 40Y-K with the intermediate transfer belt 10 sandwiched therebetween.

Of the plurality of support rollers supporting the intermediate transfer belt 10, the support roller 14 is a driving roller for rotationally driving the intermediate transfer belt 10 and is connected to a motor via a drive transmission mechanism (e.g., gear, pulley, belt). In the case of forming a monochrome image of black on the intermediate transfer belt 10, the support rollers 15 and 15', other than the support roller 14 that is a driving roller, are moved by a moving mechanism to separate the photoconductors 40Y, 40M, and 40C from the intermediate transfer belt 10.

Below the intermediate transfer belt 10 on the side opposite to the tandem image forming unit 20, a secondary transfer device 22 is disposed. Referring to FIG. 1, in the secondary transfer device 22, a secondary transfer roller 16' presses against the support roller 16 serving as a secondary transfer opposing roller to apply a transfer electric field, whereby the toner image on the intermediate transfer belt 10 is transferred onto a sheet serving as a recording medium.

On the left side of the secondary transfer device 22, a fixing device 25 that fixes a transferred image (unfixed image) on the sheet is disposed.

The sheet onto which the image has been transferred by the secondary transfer device 22 is conveyed to the fixing device 25 by a conveyance belt 24 supported by two rollers 23. The conveyance belt 24 may be replaced with a fixed guide member or a conveyance roller.

Referring to FIG. 1, below the secondary transfer device 22 and the fixing device 25 and in parallel with the tandem image forming unit 20, a sheet reversing device 28 is disposed that reverses and conveys a sheet so that images can be recorded on both sides of the sheet.

Next, a basic operation of the image forming apparatus according to the present embodiment is described with reference to FIG. 1.

The image forming apparatus illustrated in FIG. 1 forms an image based on image information from a personal computer that is a well-known computer. Specifically, the image forming apparatus illustrated in FIG. 1 forms an image in full color mode or monochrome mode according to the mode setting designated in an operation unit of the personal computer.

In a case in which the full-color mode is selected, the photoconductors 40Y-K rotate counterclockwise in FIG. 1. The surfaces of the photoconductors 40Y-K are uniformly charged by the chargers 19Y-K. The photoconductors 40Y-K are thereafter irradiated with light (e.g., laser light) from the irradiators 21 corresponding to respective color images, and electrostatic latent images corresponding to the respective color image data are formed thereon. As the photoconductors 40Y-K rotate, the electrostatic latent images are developed into toner images of respective colors in the respective developing devices 38Y-K. The toner images of respective colors are sequentially transferred onto the intermediate transfer belt 10, thus forming a full-color toner image on the intermediate transfer belt 10. After the toner image has been transferred, charge remaining on each of the photoconductors 40Y-K is optically removed by a charge removing lamp, and residual toner remaining thereon is removed by the photoconductor cleaner. Accordingly, the chargers 19Y-K, the irradiators 21, and the developing devices 38Y-K constitute image forming units for forming toner images of Y, M, C, and K on the respective photoconductors 40Y-K.

On the other hand, one of multiple feed rollers 42 disposed in the sheet feeding table 200 is selectively rotated. A sheet is fed from one of sheet trays 44 disposed in multiple stages in a paper bank 43 of the sheet feeding table 200, separated one by one by a separation roller 45, guided to a feeding path 46, conveyed by conveyance rollers 47, and guided to a feeding path 48 in the apparatus main body 100. The leading edge of the sheet is brought into contact with a registration roller (alignment roller) 49 and stopped. Alternatively, in the case of manual sheet feeding, a feed roller 50 is rotated to feed a sheet on a manual feed tray 51 to a manual feeding path 53, and the leading edge of the sheet is brought in contact with the registration roller 49 and stopped. The registration roller 49 is then rotated in synchronization with the toner image on the intermediate transfer belt 10 to feed the sheet to between the intermediate transfer belt 10 and the secondary transfer device 22, so that the secondary transfer device 22 transfers the toner image on the sheet.

The sheet onto which the toner image has been transferred is conveyed by the secondary transfer device 22 and the conveyance belt 24 and sent to the fixing device 25. In the fixing device 25, the toner image is fixed on the sheet by heat and pressure. The sheet is switched and guided by a switching claw and ejected by an ejection roller 56 onto an output tray 57. Alternatively, the direction of conveyance is switched by a switching claw and the sheet is introduced into the sheet reversing device 28. The sheet is reversed and fed to the secondary transfer device 22 again and an image is also formed on the back side of the sheet. The sheet is then ejected onto the output tray 57 by the ejection roller 56. When image formation on two or more sheets is instructed, the above-described image forming process is repeated.

When black-and-white mode is selected, the support rollers 15 and 15' move downwardly to separate the intermediate transfer belt 10 from the photoconductors 40Y, 40M, and 40C. Only the photoconductor 40K rotates counterclockwise in FIG. 1. The surface of the photoconductor 40K is uniformly charged by the charger 19K and irradiated with light (e.g., laser light) corresponding to a K image to form an electrostatic latent image. The electrostatic latent image is developed with K toner contained in the developing device 38K into a toner image. The toner image is transferred onto the intermediate transfer belt 10. At this time, the photoconductors 40Y, 40M, and 40C and the developing devices 38Y, 38M, and 38C for three colors of Y, M, and C other than K stop operating to prevent unnecessary consumption of the photoconductors and the developers.

On the other hand, a sheet is fed from the sheet trays 44 and is conveyed by the registration roller 49 in synchronization with the toner image formed on the intermediate transfer belt 10. As is the case of the full-color toner image, the toner image transferred onto the sheet is fixed thereon by the fixing device 25 and is processed through a sheet ejection system according to the designated mode. When image formation on two or more sheets is instructed, the above-described image forming process is repeated.

Fixing Device

Figure 2:
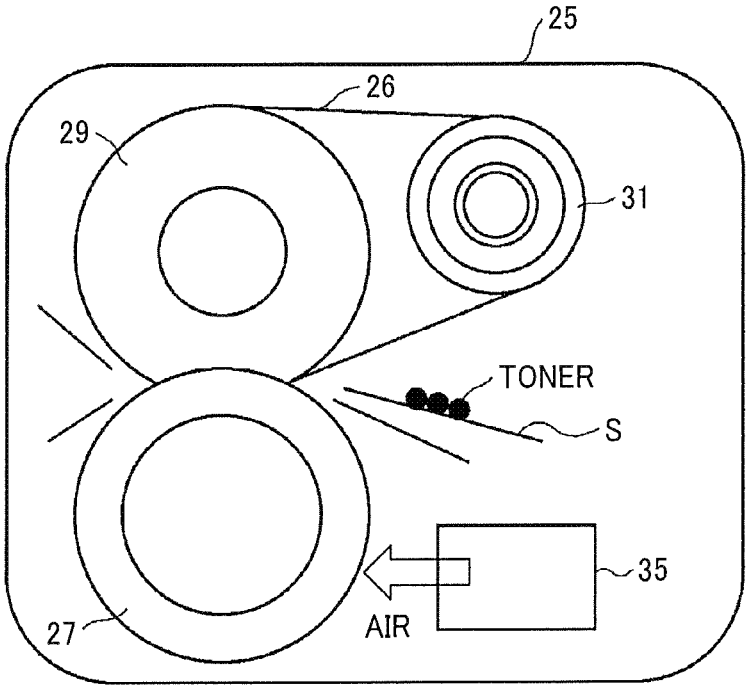
FIG. 2 is a side view of a fixing device illustrated in FIG. 1.

FIG. 2 is a schematic view of the fixing device 25.

As illustrated in FIG. 2, the fixing device 25 includes a fixing belt 26 serving as a fixing rotator and a pressure roller 27 serving as a pressure rotator. The fixing belt 26 travels in a predetermined direction to heat and melt a toner image. The pressure roller 27 presses against the fixing belt 26 to form a fixing nip through which a sheet S is conveyed.

The fixing belt 26 is an endless belt having a multilayer structure in which an elastic layer and a release layer are laminated in order on a base layer having a layer thickness of 90 μm made of a polyimide (PI) resin.

The elastic layer of the fixing belt 26 has a layer thickness of about 200 μm and is formed of an elastic material such as silicone rubber, fluororubber, and foamable silicone rubber.

The release layer of the fixing belt 26 has a layer thickness of about 20 μm and is formed of a material such as PFA (tetrafluoroethylene perfluoroalkyl vinyl ether copolymer resin), polyimide, polyether imide, and PES (polyether sulfide). As the release layer is provided as the surface layer of the fixing belt 26, a toner image is securely released from the fixing belt 26 and well fixed on the sheet S and the sheet S is well separated from the fixing belt 26.

The fixing device 25 further includes a fixing roller 29 and a heating roller 31 inside the loop of the fixing belt 26. The heating roller 31 is serving as a heater for heating the fixing belt 26.

The fixing roller 29 has a silicone rubber layer having a thickness of from 5 to 30 mm on a core metal. The fixing roller 29 presses against the pressure roller 27 via the fixing belt 26, thereby forming a fixing nip.

The heating roller 31 is made of a metal such as aluminum, SUS (stainless steel), and copper. The heat source thereof may be a halogen heater or an IH (induction heating) heater.

When the heat source is a halogen heater, the halogen heater is disposed inside the heating roller 31. When the heat source is an IH heater, the IH heater is disposed outside the loop of the fixing belt 26.

A heat pipe may be press-fitted to the heating roller 31 for the purpose of equalizing the temperature in the axial direction.

The fixing device 25 further includes a cooling fan 35 that blows air to the pressure roller 27 to cool the pressure roller 27.

Next, a pressure roller driving system and a fixing roller driving system are described below with reference to FIGS. 3A and 3B, respectively.

Figure 3A:
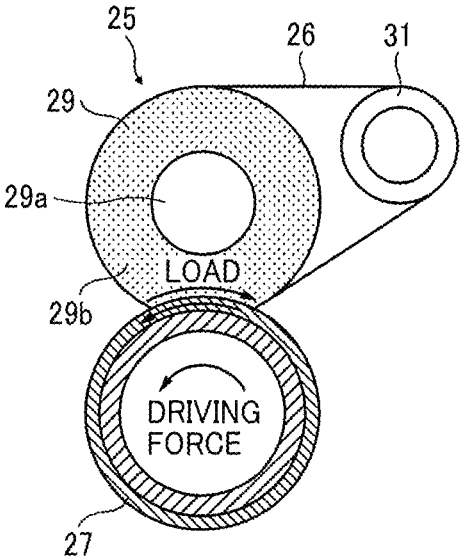
FIGS. 3A and 3B are schematic diagrams illustrating a pressure roller driving system and a fixing roller driving system, respectively.
Figure 3B:
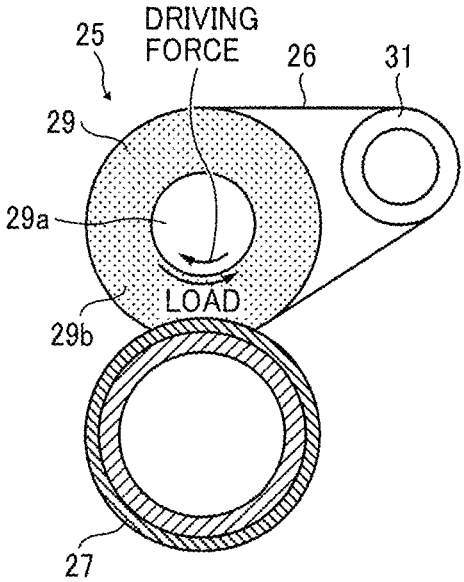
Figure 3C:
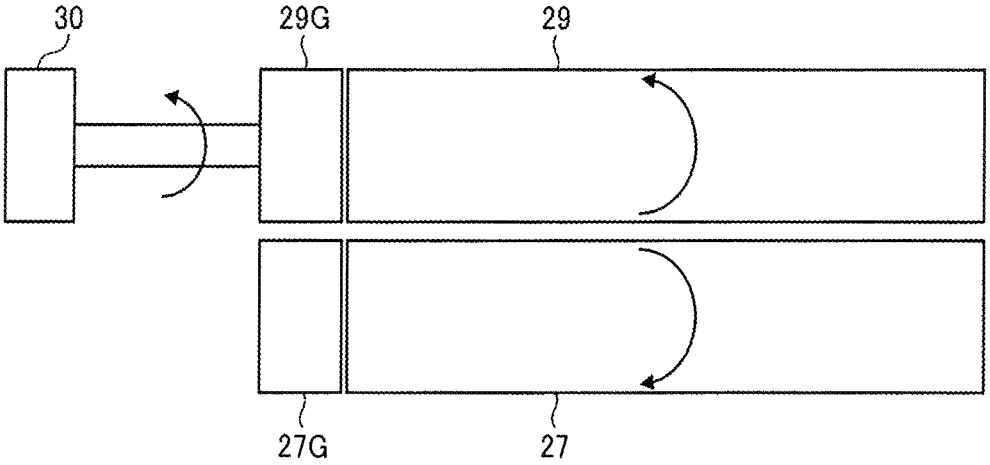
FIG. 3C is another schematic diagram illustrating the fixing roller driving system illustrated in FIG. 3B.

As illustrated in FIG. 3B, a system in which a driving force is applied to the fixing roller 29 to drive the fixing device 25 is called a fixing roller driving system. Specifically, as illustrated in FIG. 3C, a gear 29G mounted on the fixing roller 29 is driven by a motor 30, serving as a driving source, to drive a gear 27G mounted on the pressure roller 27, thereby rotating the pressure roller 27.

In the fixing roller driving system, a shear force generated in the fixing nip is small. This is because the amount of deformation of the pressure roller 27 as a driven member is small, so that the load required for rotating the pressure roller 27 includes only a rotational load. In other words, since the pressure roller 27 hardly deforms and almost no load other than a load from a web is applied to the fixing roller 29, a rubber compression load of the fixing roller 29 and the fixing roller driving force are applied to an interface between a core metal 29*a* and an elastic layer 29*b* of the fixing roller 29.

As illustrated in FIG. 3A, a system in which a driving force is applied to the pressure roller 27 to drive the fixing device 25 is called a pressure roller driving system.

In the pressure roller driving system, the amount of deformation of the fixing roller 29 as a driven member is large due to a thick elastic layer 29*b*, so that the load required for rotating the fixing roller 29 includes both a rotational load and a deformation load of the fixing roller 29. Therefore, in the pressure roller driving system, a shear force generated in the fixing nip is large.

Next, a state of a thin sheet of paper after exiting the fixing nip in the pressure roller driving system and the fixing roller driving system is described below with reference to FIGS. 4A and 4B, respectively.

Figure 4A:
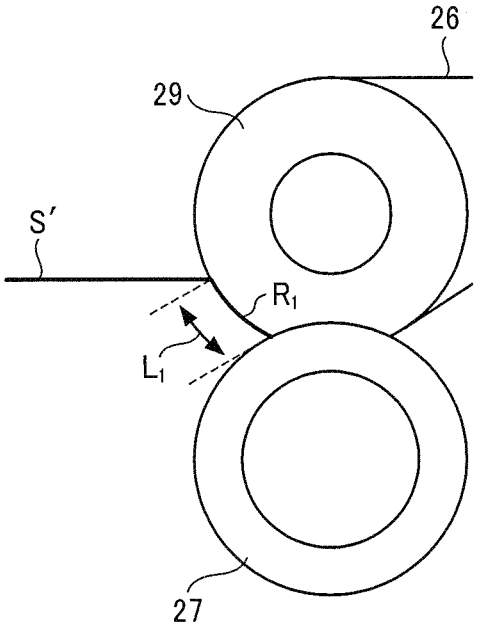
FIGS. 4A and 4B are schematic diagrams illustrating a state of a thin sheet of paper after exiting the fixing nip.
Figure 4B:
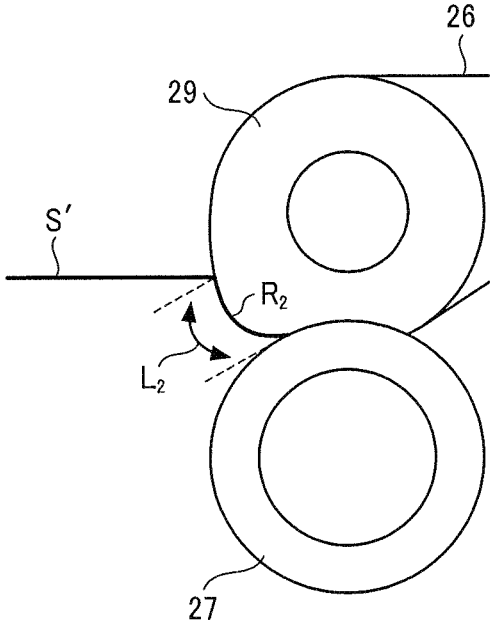

In the fixing roller driving system illustrated in FIG. 4B, after a thin sheet S' that easily winds around the fixing belt 26 exits the fixing nip, the thin sheet S' comes into contact with the fixing belt 26 having a large curvature $R_2$ at a long distance (for a long time) $L_2$.

On the other hand, in the pressure roller driving system illustrated in FIG. 4A, after the thin sheet S' exits the fixing nip, the thin sheet S' comes into contact with the fixing belt 26 having a small curvature $R_1$ at a short distance (for a short time) $L_1$.

Therefore, in the fixing roller driving system, the amount of wax exuding on the surface of the toner image and transferring to the fixing belt 26 is large and a glossy residual image may occur. Therefore, in the case of using the thin sheet S', the pressing force between the fixing roller 29 and the pressure roller 27 is increased to reduce the curvature $R_2$ of the fixing belt 26 on the downstream side of the fixing nip. As a result, the distance $L_2$ is shortened and the amount of wax transferring to the fixing belt 26 is reduced, thereby suppressing the occurrence of a glossy residual image in the case of using the thin sheet S'.

Figure 5:
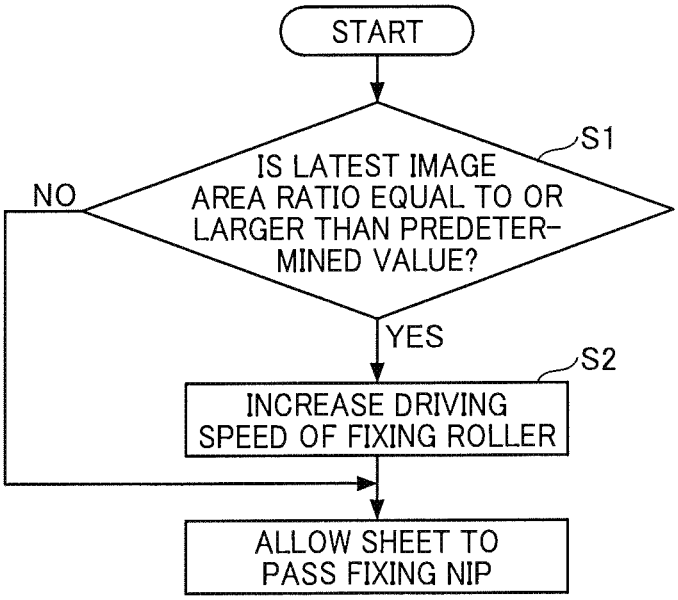
FIG. 5 is a flow chart of a fixing control mechanism according to the latest image area ratio.

Next, a fixing control mechanism according to the latest image area ratio is described below with reference to FIG. 5.

As the latest image area ratio, that is, the image area ratio of the sheet having passed the fixing nip immediately before, becomes larger, the amount of wax transferring to the fixing belt 26 becomes larger and a glossy residual image is more likely to occur. Therefore, when the latest image area ratio is large, the nip time is changed to reduce the amount of wax transferring to the fixing belt 26. The shorter the nip time, the shorter the time within which the shear force between the fixing belt 26 and the toner image is applied and the smaller the amount of wax transferring to the fixing belt 26, thereby suppressing the occurrence of a glossy residual image.

More specifically, first, whether or not the latest image area ratio is equal to or larger than a predetermined value is determined (S1). Next, if the latest image area ratio is equal to or larger than the predetermined value, the driving speed of the fixing roller 29 is increased (S2) and then a sheet is allowed to pass the fixing nip. If the latest image area ratio is less than the predetermined value, a sheet is allowed to pass the fixing nip without changing the driving speed of the fixing roller 29.

Figure 6:
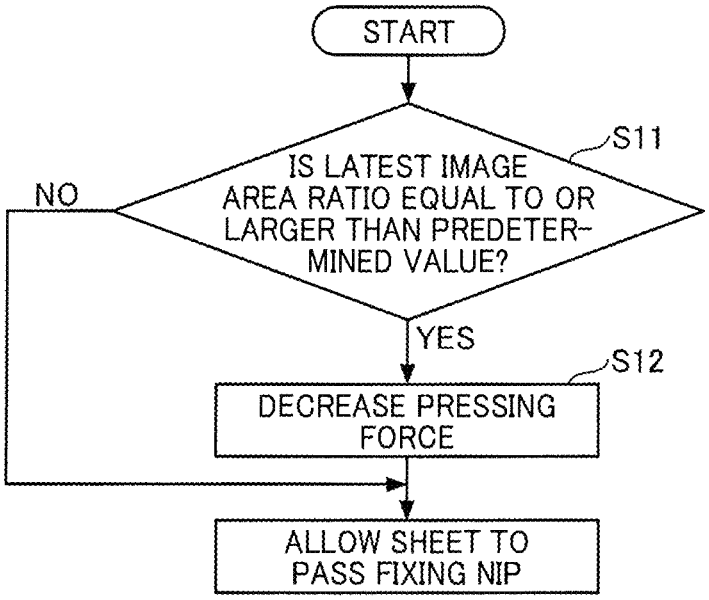
FIG. 6 is a flow chart of another fixing control mechanism according to the latest image area ratio.

Next, another fixing control mechanism according to the latest image area ratio is described below with reference to FIG. 6.

When the latest image area ratio is large, the nip pressure is changed to reduce the amount of wax transferring to the fixing belt 26. The shorter the nip pressure, the smaller the shear force between the fixing belt 26 and the toner image and the smaller the amount of wax transferring to the fixing belt 26, thereby suppressing the occurrence of a glossy residual image.

More specifically, first, whether or not the latest image area ratio is equal to or larger than a predetermined value is determined (S11). Next, if the latest image area ratio is equal to or larger than the predetermined value, the pressing force between the fixing roller 29 and the pressure roller 27 is reduced (S12) and then a sheet is allowed to pass the fixing nip. If the latest image area ratio is less than the predetermined value, a sheet is allowed to pass the fixing nip without changing the pressing force between the fixing roller 29 and the pressure roller 27.

Toner

The toner contains a binder resin, a colorant, and a release agent. The toner may optionally contain other components such as a charge control agent and an additive as necessary.

Preferably, the toner has a release agent amount indicator of from 0.01 to 0.20, more preferably from 0.04 to 0.14. Here, the release agent amount indicator indicates an amount of the release agent present within a region ranging from a surface to a depth of 0.3 μm of the toner, and is represented by a ratio ($P_{2850}/P_{828}$) of an intensity ($P_{2850}$) at a wave number of 2,850 $cm^{-1}$ to an intensity ($P_{828}$) at a wave number of 828 $cm^{-1}$ of the toner measured by a Fourier transform infrared spectroscopy attenuated total reflection method (hereinafter "FTIR-ATR method"). When $P_{2850}/P_{828}$ is less than 0.01, the amount of release agent in the vicinity of the surface of the toner is small and fixing releasability is lowered. When $P_{2850}/P_{828}$ is larger than 0.20, the amount of release agent in the vicinity of the surface of the toner is large and a glossy residual image is likely to occur.

The intensity ($P_{2850}$) at a wave number of 2850 $cm^{-1}$ measured by the FTM-ATR method is correlated with the amount of release agent present in the vicinity of the surface of the toner. The intensity ($P_{828}$) at a wave number of 828 $cm^{-1}$ measured by the FTIR-ATR method is correlated with the amount of binder resin present in the vicinity of the surface of the toner. Therefore, the relative amount of release agent (wax) in the vicinity of the surface of the toner can be determined by the intensity ratio ($P_{2850}/P_{828}$).

Preferably, the toner has a glass transition temperature ($Tg_{1st}$) of from 45° C. to 65° C. measured in a first temperature rising in a differential scanning calorimetry (hereinafter "DSC").

Preferably, a tetrahydrofuran-insoluble ("THF-insoluble") matter in the toner has two glass transition temperatures $Tg_{a1st}$ of from −45° C. to 5° C. and $Tg_{b1st}$ of from 45° C. to 70° C. measured in the first temperature rising in the DSC.

Preferably, a tetrahydrofuran-soluble ("THF-soluble") matter in the toner has a glass transition temperature ($Tg_{2nd}$) of from 40° C. to 65° C. measured in a second temperature rising in the DSC.

Preferably, the THF-insoluble matter is a polyester resin and $Tg_{a1st}$ and $Tg_{a1st}$ are derived from respective two resin components, i.e., a polyester resin component A and a polyester resin component B, respectively. The two glass transition temperatures of the THF-insoluble matter are derived from respective two types of polyesters (prepolymers) having different physical properties.

Preferably, the THF-insoluble matter of the toner has a glass transition temperature ($Tg_{2nd'}$) of from 0° C. to 50° C. measured in the second temperature rising in the DSC.

Preferably, the THF-soluble matter is a polyester resin. In this case, preferably, the THF-soluble matter has a $Tg_{2nd}$ of from 40° C. to 65° C.

Preferably, the toner further contains a crystalline resin. As the crystalline resin is dissolved in other binder resins, the glass transition temperature of the total binder resin is lowered. When such a toner is combined with the fixing roller driving system, excellent low-temperature fixability is achieved.

Release Agent

The release agent is not limited to any particular material and can be selected from known materials.

Specific examples of the release agent include, but are not limited to, waxes, particularly natural waxes such as plant waxes (e.g., carnauba wax, cotton wax, sumac wax, rice wax), animal waxes (e.g., bees wax, lanolin), mineral waxes (e.g., ozokerite, ceresin), and petroleum waxes (e.g., paraffin wax, microcrystalline wax, petrolatum wax).

In addition to these natural waxes, synthetic hydrocarbon waxes (e.g., Fischer-Tropsch wax, polyethylene wax, polypropylene wax) and synthetic waxes (e.g., ester wax, ketone wax, ether wax) may also be used.

Furthermore, the following materials are also usable as the release agent: fatty acid amide compounds such as 12-hydroxystearic acid amide, stearic acid amide, phthalic anhydride imide, and chlorinated hydrocarbon; homopolymers and copolymers of polyacrylates (e.g., poly-n-stearyl methacrylate, poly-n-lauryl methacrylate), which are low-molecular-weight crystalline polymers, such as copolymer of n-stearyl acrylate and ethyl methacrylate; and crystalline polymers having a long alkyl side chain.

Among these materials, hydrocarbon waxes such as paraffin wax, micro-crystalline wax, Fischer-Tropsch wax, polyethylene wax, and polypropylene wax are preferable.

The melting point of the release agent is not particularly limited and may be appropriately selected according to the purpose, but is preferably from 60° C. to 80° C. When the melting point is less than 60° C., the release agent easily melts at low temperatures so that heat resistant storage stability is poor. When the melting point is higher than 80° C., the release agent insufficiently melts even in the fixable temperature range within which the resin melts, causing fixing offset and defective image.

The content of the release agent is not particularly limited and may be appropriately selected according to the purpose, but is preferably from 2 to 10 parts by mass, more preferably from 3 to 8 parts by mass, based on 100 parts by mass of the toner. When the content is less than 2 parts by mass, high-temperature offset resistance at the time of fixing and low-temperature fixability may be poor. When the content is larger than 10 parts by mass, heat-resistant storage stability may be poor and image fog may occur. When the content is within the preferred range, image quality and fixing stability are advantageously improved.

Preferably, the release agent is present being dispersed in mother toner particles. Therefore, it is preferable that the release agent and the binder resin are not compatible with each other. A method of finely dispersing the release agent in the mother toner particles is not particularly limited and can be appropriately selected according to the purpose. For example, the release agent can be dispersed by a shear force applied in a kneading process in the toner production process.

The amount of release agent in the vicinity of the surface of the toner is determined by the FTIR-ATR (Fourier transform infrared attenuated total reflection spectroscopy) method. According to the measurement principle of FTIR-ATR, the analyzing depth is about 0.3 μm. Thus, the relative amount of release agent present within a region ranging from the surface to 0.3 μm in depth of the toner can be measured. Specific measurement procedures are as follows.

First, 3 g of the toner is pressed with a load of 6 t for 1 minute using an automatic pelletizer (Type M No. 50 BRP-E from Maekawa Testing Machine Mfg. Co., LTD.) and formed into a pellet having a diameter of 40 mm and a thickness of about 2 mm. The surface of the pellet is subjected to a measurement by the FTIR-ATR method. As a measuring device, a microscopic FTIR device SPECTRUM ONE (from PerkinElmer Japan Co., Ltd.) equipped with an ATR unit is used. The measurement is performed in micro ATR mode using a germanium (Ge) crystal having a diameter of 100 μm. The incident angle of infrared ray is 41.5°, the resolution is 4 $cm^{-1}$, and the cumulated number is 20. The ratio ($P_{2850}/P_{828}$) of the intensity ($P_{2850}$) at a wave number of 2,850 $cm^{-1}$ to the intensity ($P_{828}$) at a wave number of 828 $cm^{-1}$ is taken as an indicator of the relative amount of release agent in the vicinity of the toner surface. $P_{2850}/P_{828}$ is measured at four different positions and the measured values are averaged.

Binder Resin

The binder resin has no particular limitation, and a commonly-used resin can be suitably selected and used as the binder resin. Specific examples of the binder resin include, but are not limited to, vinyl polymers (e.g., homopolymers of a styrene monomer, an acrylic monomer, or a methacrylic monomer, and copolymers of at least two of the monomers), polyester polymers, polyol resins, phenol resins, silicone resins, polyurethane resins, polyamide resins, furan resins, epoxy resins, xylene resins, terpene resins, coumarone indene resins, polycarbonate resins, and petroleum resins. Among these, polyester polymers (polyester resins) are preferable, and unmodified polyester resins are more preferable. Here, the unmodified polyester resin refers to a polyester resin that is obtained from a polyol and a polycarboxylic acid or derivative thereof (e.g., a polycarboxylic acid anhydride, a polycarboxylic acid ester) and that is unmodified with a polyisocyanate or the like.

Polyester Resin Component A Insoluble in Tetrahydrofuran (THF)

Preferably, the polyester resin component A comprises a polyol component and a polycarboxylic acid component, and the polyol component is a diol component.

Examples of the diol component include, but are not limited to, aliphatic diols having 3 to 10 carbon atoms.

Specific examples of the aliphatic diols having 3 to 10 carbon atoms include, but are not limited to, 1,2-propylene glycol, 1,3-propylene glycol, 1,4-butanediol, 2-methyl-1,3-propanediol, 1,5-pentanediol, 3-methyl-1,5-pentanediol, 1,6-hexanediol, 1,8-octanediol, 1,10-decanediol, and 1,12-dodecanediol.

The content of the aliphatic diol having 3 to 10 carbon atoms in the polyol component is preferably 50% by mol or more, more preferably 80% by mol or more.

Preferably, the diol component of the polyester resin component A has a main chain containing carbon atoms in an odd number of from 3 to 9 and a side chain containing an alkyl group. In particular, the diol component represented by the following general formula (1) is preferable.

$$HO—(CX_1X_2)_n—OH \quad (1)$$

In the above formula, each of $X_1$ and $X_2$ independently represents a hydrogen atom or an alkyl group having 1 to 3 carbon atoms. n represents an odd number of from 3 to 9. In the repeating units in the number of n, $X_1$ and $X_2$ may be either the same or different.

It is preferable that the polyester resin component A contains a cross-linking component. Preferably, the cross-linking component comprises an aliphatic alcohol having a valence of 3 or more. More preferably, the cross-linking component comprises a trivalent or tetravalent aliphatic alcohol for glossiness and image density of the fixed image. Preferred examples of the trivalent or tetravalent aliphatic alcohol include trivalent or tetravalent aliphatic polyols having 3 to 10 carbon atoms. Alternatively, the cross-linking component may comprise only the aliphatic alcohol having a valence of 3 or more.

The aliphatic alcohol having a valence of 3 or more can be appropriately selected according to the purpose. Examples thereof include, but are not limited to, glycerin, trimethylolethane, trimethylolpropane, pentaerythritol, sorbitol, and dipentaerythritol. Each of these aliphatic alcohols having a valence of 3 or more may be used alone or in combination with others.

Also, the cross-linking component of the polyester resin component A may comprise a carboxylic acid having a valence of 3 or more or an epoxy compound. However, the aliphatic alcohol having a valence of 3 or more is more preferable as the cross-linking component for suppressing unevenness and achieving sufficient glossiness and image density.

The proportion of the cross-linking component in the polyester resin component A is not particularly limited and may be appropriately selected depending on the purpose, but is preferably from 0.5% to 5% by mass, more preferably from 1% to 3% by mass.

The proportion of the aliphatic alcohol having a valence of 3 or more in the polyol component of the polyester resin component A is not particularly limited and may be appropriately selected depending on the purpose, but is preferably from 50% to 100% by mass, more preferably from 90% to 100% by mass.

Preferably, the polyester resin component A comprises a dicarboxylic acid component, and the dicarboxylic acid component comprises an aliphatic dicarboxylic acid having 4 to 12 carbon atoms in an amount of 50% by mol or more.

Specific examples of the aliphatic dicarboxylic acid having 4 to 12 carbon atoms include, but are not limited to, succinic acid, glutaric acid, adipic acid, pimelic acid, suberic acid, azelaic acid, sebacic acid, and dodecanedioic acid.

Preferably, the polyester resin component A has urethane bond and/or urea bond for exhibiting excellent adhesion property to recording media such as paper. In this case, urethane bond and/or urea bond behave as pseudo cross-linked points, thereby enhancing rubber property of the polyester resin component A and improving heat-resistant storage stability and high-temperature offset resistance of the toner.

The molecular weight of the polyester resin component A is not particularly limited and may be appropriately selected depending on the purpose. However, when the molecular weight is too low, the toner may be poor in heat-resistant storage stability and durability against stress such as stirring in a developing device. When the molecular weight is too high, viscoelasticity of the toner becomes too high when the toner melts, resulting in poor low-temperature fixability. Accordingly, the weight average molecular weight (Mw), measured by gel permeation chromatography (GPC), is preferably from 100,000 to 200,000.

The glass transition temperature (Tg) of the polyester resin component A is from −50° C. to 0° C., preferably from −40° C. to −20° C. When the Tg is less than −50° C., heat-resistant storage stability, resistance to stress such as stirring in a developing device, and filming resistance of the toner may be poor. When the Tg in higher than 0° C., the toner insufficiently deforms even when heated and pressurized at the time of fixing, resulting in poor low-temperature fixability.

Polyester Resin Component B Insoluble in Tetrahydrofuran (THF)

Preferably, the polyester resin component B comprises a polyol component and a polycarboxylic acid component. It is also preferable that the polyester resin component B is a modified polyester having both an ester bond and another bonding unit other than the ester bond. Preferably, a binder resin precursor is a resin precursor capable of forming such a modified polyester.

Specific examples of the polyol component include, but are not limited to, alkylene glycols (e.g., ethylene glycol, 1,2-propylene glycol, 1,3-propylene glycol, 1,4-butanediol, 1,6-hexanediol); alkylene ether glycols (e.g., diethylene glycol, triethylene glycol, dipropylene glycol, polyethylene glycol, polypropylene glycol, polytetramethylene ether glycol); alicyclic diols (e.g., 1,4-cyclohexanedimethanol, hydrogenated bisphenol A); bisphenols (e.g., bisphenol A, bisphenol F, bisphenol S); alkylene oxide (e.g., ethylene oxide, propylene oxide, butylene oxide) adducts of the above alicyclic diols; alkylene oxide (e.g., ethylene oxide, propylene oxide, butylene oxide) adducts of the above bisphenols; and combinations thereof. Among these compounds, alkylene glycols having 2 to 12 carbon atoms and alkylene oxide adducts of bisphenols (e.g., ethylene oxide 2 mol adduct of bisphenol A, propylene oxide 2 mol adduct of bisphenol A, propylene oxide 3 mol adduct of bisphenol A) are preferable.

Specific examples of polyols having a valence of 3 or more include, but are not limited to, polyvalent aliphatic alcohols (e.g., glycerin, trimethylolethane, trimethylolpropane, pentaerythritol, sorbitol), polyphenols having a valence of 3 or more (e.g., phenol novolac, cresol novolac), alkylene oxide adducts of the polyphenols having a valence of 3 or more, and combinations thereof.

Specific examples of divalent carboxylic acids include, but are not limited to, alkylene dicarboxylic acids (e.g., succinic acid, adipic acid, sebacic acid), alkenylene dicarboxylic acids (e.g., maleic acid, fumaric acid), aromatic dicarboxylic acids (e.g., terephthalic acid, isophthalic acid, naphthalenedicarboxylic acid), and combination thereof. Among these compounds, alkenylene dicarboxylic acids having 4 to 20 carbon atoms and aromatic dicarboxylic acids having 8 to 20 carbon atoms are preferable.

Specific examples of polycarboxylic acids having a valence of 3 or more include, but are not limited to, aromatic polycarboxylic acids having 9 to 20 carbon atoms (e.g., trimellitic acid, pyromellitic acid) and combinations thereof.

In addition, an anhydride or lower alkyl ester (e.g., methyl ester, ethyl ester, and isopropyl ester) of the polycarboxylic acid may be used in place of the polycarboxylic acid.

Preferably, the polyester resin component B has urethane bond and/or urea bond for exhibiting excellent adhesion property to recording media such as paper. In this case, urethane bond and/or urea bond behave as pseudo cross-linked points, thereby enhancing rubber property of the polyester resin component B and improving heat-resistant storage stability and high-temperature offset resistance of the toner.

The glass transition temperature (Tg) of the polyester resin component B is from 45° C. to 65° C., preferably from 50° C. to 60° C. When the Tg is less than 45° C., heat-resistant storage stability, resistance to stress such as stirring in a developing device, and filming resistance of the toner may be poor. When the Tg in higher than 65° C., the toner insufficiently deforms even when heated and pressurized at the time of fixing, resulting in poor low-temperature fixability.

Polyester Resin Component C Soluble in Tetrahydrofuran (THF)

Preferably, the polyester resin component C comprises a diol component and a dicarboxylic acid component. More preferably, the polyester resin component C comprises an alkylene glycol in an amount of 40% by mol or more. The polyester resin component C may or may not comprise a cross-linking component.

Preferably, the polyester resin component C is a linear polyester resin.

In addition, preferably, the polyester resin component C is an unmodified polyester resin. Here, the unmodified polyester resin refers to a polyester resin that is obtained from a polyol and a polycarboxylic acid or derivative thereof (e.g., a polycarboxylic acid anhydride, a polycarboxylic acid ester) and that is unmodified with an isocyanate compound or the like. Examples of the polyol include, but are not limited to, diols.

Specific examples of the diols include, but are not limited to, alkylene (C2-C3) oxide adducts of bisphenol A with an average addition molar number of 1 to 10 (e.g., polyoxypropylene(2.2)-2,2-bis(4-hydroxyphenyl)propane, polyoxyethylene(2.2)-2,2-bis(4-hydroxyphenyl)propane), ethylene glycol, propylene glycol, hydrogenated bisphenol A, and alkylene (C2-C3) oxide adducts of hydrogenated bisphenol A with an average addition molar number of 1 to 10.

Each of these compounds can be used alone or in combination with others.

Examples of the polycarboxylic acid include, but are not limited to, dicarboxylic acids.

Specific examples of the dicarboxylic acids include, but are not limited to: adipic acid, phthalic acid, isophthalic acid, terephthalic acid, fumaric acid, and maleic acid; and succinic acid derivatives substituted with an alkyl group having 1 to 20 carbon atoms or an alkenyl group having 2 to 20 carbon atoms, such as dodecenyl succinic acid and octyl succinic acid. In particular, the polycarboxylic acid comprises terephthalic acid in an amount of 50% by mol or more.

Each of these compounds can be used alone or in combination with others.

The polyester resin component C may contain a carboxylic acid having a valence of 3 or more and/or an alcohol having a valence of 3 or more on a terminal of the resin chain for the purpose of adjusting acid value and/or hydroxyl value.

Specific examples of the carboxylic acid having a valence of 3 or more include, but are not limited to, trimellitic acid, pyromellitic acid, and anhydrides thereof.

Specific examples of the alcohol having a valence of 3 or more include, but are not limited to, glycerin, pentaerythritol, and trimethylolpropane.

It is preferable that the polyester resin component C contains a cross-linking component. Preferably, the cross-linking component comprises an aliphatic alcohol having a valence of 3 or more. More preferably, the cross-linking component comprises a trivalent or tetravalent aliphatic alcohol for glossiness and image density of the fixed image. Preferred examples of the trivalent or tetravalent aliphatic alcohol include trivalent or tetravalent aliphatic polyols having 3 to 10 carbon atoms. Alternatively, the cross-linking component may comprise only the aliphatic alcohol having a valence of 3 or more.

The aliphatic alcohol having a valence of 3 or more can be appropriately selected according to the purpose. Examples thereof include, but are not limited to, glycerin, trimethylolethane, trimethylolpropane, pentaerythritol, sorbitol, and dipentaerythritol. Each of these aliphatic alcohols having a valence of 3 or more may be used alone or in combination with others.

Also, the cross-linking component of the polyester resin component C may comprise a carboxylic acid having a valence of 3 or more or an epoxy compound. However, the aliphatic alcohol having a valence of 3 or more is more preferable as the cross-linking component for suppressing unevenness and achieving sufficient glossiness and image density.

The molecular weight of the polyester resin component C is not particularly limited and may be appropriately selected depending on the purpose. However, when the molecular weight is too low, the toner may be poor in heat-resistant storage stability and durability against stress such as stirring in a developing device. When the molecular weight is too high, viscoelasticity of the toner becomes too high when the toner melts, resulting in poor low-temperature fixability. When the amount of components having a molecular weight of 600 or less is too large, the toner may be poor in heat-resistant storage stability and durability against stress such as stirring in a developing device. When the amount of components having a molecular weight of 600 or less is too small, low-temperature fixability may be poor.

Accordingly, preferably, the weight average molecular weight (Mw) is from 3,000 to 10,000 and the number average molecular weight (Mn) is from 1,000 to 4,000, when measured by gel permeation chromatography (GPC). The ratio Mw/Mn is preferably from 1.0 to 4.0. More preferably, the weight average molecular weight (Mw) is from 4,000 to 7,000, the number average molecular weight (Mn) is from 1,500 to 3,000, and the ratio Mw/Mn is from 1.0 to 3.5.

Further, the content of components having a molecular weight of 600 or less in the THF-soluble matter is preferably from 2% to 10% by mass. The polyester resin component C may be extracted with methanol to remove components having a molecular weight of 600 or less and purified.

The acid value of the polyester resin component C is not particularly limited and may be appropriately selected according to the purpose, but is preferably from 1 to 50 mgKOH/g, and more preferably from 5 to 30 mgKOH/g. When the acid value is 1 mgKOH/g or higher, the toner becomes more negatively-chargeable and more compatible with paper when being fixed thereon, thereby improving low-temperature fixability. When the acid value is higher than 50 mgKOH/g, charge stability, particularly charge stability against environmental fluctuation, may deteriorate.

The hydroxyl value of the polyester resin component C is not particularly limited and may be appropriately selected depending on the purpose, but it is preferably 5 mgKOH/g or higher.

The glass transition temperature (Tg) of the polyester resin component C is from 45° C. to 65° C., preferably from 50° C. to 60° C. When the Tg is less than −45° C., heat-resistant storage stability, resistance to stress such as stirring in a developing device, and filming resistance of the toner may be poor. When the Tg in higher than 65° C., the toner insufficiently deforms even when heated and pressurized at the time of fixing, resulting in poor low-temperature fixability.

The content of the polyester resin component C in 100 parts by mass of the toner is preferably from 80 to 90 parts by mass, more preferably 80 parts by mass. In a three-component system of the present embodiment including the polyester resin component A, the polyester resin component B, and the polyester resin component C, when the content of the polyester resin component C is less than 80 parts by mass, the polyester resin component A and the polyester resin component B separate from each other, thereby degrading dispersibility of the colorant in the toner and lowering coloring power of the toner.

Preferably, the binder resin includes a polyester resin having urethane bond and/or urea bond. The polyester resin having urethane bond and/or urea bond is not particularly limited and can be appropriately selected according to the purpose. Examples thereof include, but are not limited to, a reaction product of a polyester resin having an active hydrogen group with a polyisocyanate. This reaction product is preferably used as a reaction precursor (hereinafter "prepolymer") that reacts with a curing agent (to be described later).

Polyester Resin Having Active Hydrogen Group

The polyester resin having an active hydrogen group may be obtained by a polycondensation of a diol, a dicarboxylic acid, and at least one of an alcohol having a valence of 3 or more and a carboxylic acid having a valence of 3 or more. The alcohol having a valence of 3 or more and the carboxylic acid having a valence of 3 or more impart a branched structure to the resulting polyester resin having an isocyanate group.

Specific examples of the diol, the dicarboxylic acid, the alcohol having a valence of 3 or more, and the carboxylic acid having a valence of 3 or more include, the above-described examples of the diol, the dicarboxylic acid, the alcohol having a valence of 3 or more, and the carboxylic acid having a valence of 3 or more, respectively.

Polyisocyanate

The polyisocyanate is not particularly limited and may be appropriately selected depending on the purpose. Examples of the polyisocyanate include, but are not limited to, diisocyanates and isocyanates having a valence of 3 or more.

Specific examples of the diisocyanates include, but are not limited to, aliphatic diisocyanates, alicyclic diisocyanates, aromatic diisocyanates, aromatic aliphatic diisocyanates, isocyanurates, and these diisocyanates blocked with a phenol derivative, oxime, or caprolactam.

Specific examples of the aliphatic diisocyanates include, but are not limited to, tetramethylene diisocyanate, hexamethylene diisocyanate, 2,6-diisocyanatocaproic acid methyl ester, octamethylene diisocyanate, decamethylene diisocyanate, dodecamethylene diisocyanate, tetramethylene diisocyanate, trimethylhexane diisocyanate, and tetramethylhexane diisocyanate.

Specific examples of the alicyclic diisocyanates include, but are not limited to, isophorone diisocyanate and cyclohexylmethane diisocyanate.

Specific examples of the aromatic diisocyanates include, but are not limited to, tolylene diisocyanate, diisocyanatodiphenylmethane, 1,5-naphthylene diisocyanate, 4,4'-diisocyanatodiphenyl, 4,4'-diisocyanato-3,3'-dimethyldiphenyl, 4,4'-diisocyanato-3-methyldiphenylmethane, and 4,4'-diisocyanato-diphenyl ether.

Specific examples of the aromatic aliphatic diisocyanates include, but are not limited to, $\alpha,\alpha,\alpha',\alpha'$-tetramethylxylylene diisocyanate.

Specific examples of the isocyanurates include, but are not limited to, tris(isocyanatoalkyl) isocyanurate and tris (isocyanatocycloalkyl) isocyanurate Each of these polyisocyanates can be used alone or in combination with others.

Curing Agent

The curing agent is not particularly limited as long as it reacts with a prepolymer and can be appropriately selected according to the purpose. Examples of the curing agent include, but are not limited to, compounds having an active hydrogen group.

Compound Having Active Hydrogen Group

The active hydrogen group in the compound is not particularly limited and may be appropriately selected according to the purpose. Specific examples of the active hydrogen group in the compound include, but are not limited to, hydroxyl groups (e.g., alcoholic hydroxyl group, phenolic hydroxyl group), amino group, carboxyl group, and mercapto group. Each of these active hydrogen groups may be used alone or in combination with others.

Preferably, the compound having an active hydrogen group is an amine, because amines are capable of forming urea bond.

Examples of the amines include, but are not limited to, diamines, amines having a valence of 3 or more, amino alcohols, amino mercaptans, and amino acids, and these amines in which the amino group is blocked. Each of these compounds can be used alone or in combination with others.

In particular, a diamine alone and a mixture of a diamine with a small amount of an amine having a valence of 3 or more are preferable.

Examples of the diamines include, but are not limited to, aromatic diamines, alicyclic diamines, and aliphatic diamines. Specific examples of the aromatic diamines include, but are not limited to, phenylenediamine, diethyltoluenediamine, and 4,4'-diaminodiphenylmethane. Specific examples of the alicyclic diamines include, but are not limited to, 4,4'-diamino-3,3'-dimethyldicyclohexylmethane, diaminocyclohexane, and isophoronediamine. Specific examples of the aliphatic diamines include, but are not limited to, ethylenediamine, tetramethylenediamine, and hexamethylenediamine.

Specific examples of the amines having a valence of 3 or more include, but are not limited to, diethylenetriamine and triethylenetetramine.

Specific examples of the amino alcohols include, but are not limited to, ethanolamine and hydroxyethylaniline.

Specific examples of the amino mercaptans include, but are not limited to, aminoethyl mercaptan and aminopropyl mercaptan.

Specific examples of the amino acids include, but are not limited to, aminopropionic acid and aminocaproic acid.

Specific examples of the amines in which the amino group is blocked include, but are not limited to, ketimine compounds in which the amino group is blocked with a ketone such as acetone, methyl ethyl ketone, and methyl isobutyl ketone; and oxazoline compounds.

The molecular structure of the polyester resin components can be determined by, for example, solution or solid NMR (nuclear magnetic resonance), X-ray diffractometry, GC/MS (gas chromatography-mass spectroscopy), LC/MS (liquid chromatography-mass spectroscopy), or IR (infrared spectroscopy). For example, IR can simply detect a polyester resin as a substance showing no absorption peak based on OCH (out-of-plane bending vibration) of olefin at 965±10 $cm^{-1}$ and 990±10 $cm^{-1}$ in an infrared absorption spectrum.

Crystalline Polyester Resin D

As an example of the crystalline resin, a crystalline polyester resin D (hereinafter simply "crystalline polyester resin") is described in detail below. The crystalline polyester resin has a heat melting property such that the viscosity rapidly decreases at around the fixing start temperature due to its high crystallinity. When used in combination with the polyester resin, the crystalline polyester resin can maintain good storage stability below the melting start temperature due to its crystallinity, but upon reaching the melting start temperature, the crystalline polyester resin melts while rapidly reducing its viscosity ("sharply-melting property"). The crystalline polyester resin then compatibilizes with the polyester resin and together rapidly reduces viscosity to be fixed on a recording medium. Thus, the toner exhibits excellent heat-resistant storage stability and low-temperature fixability. By combining such a toner with the fixing roller driving system, a wide releasable range (i.e., the difference between the lowest fixable temperature and the high-temperature offset generating temperature) is exhibited.

The crystalline polyester resin is obtained from a polyol and a polycarboxylic acid or derivative thereof, such as a polycarboxylic acid anhydride and a polycarboxylic acid ester.

In the present embodiment, the crystalline polyester resin refers to a resin obtained from a polyol and a polycarboxylic acid or derivative thereof, such as a polycarboxylic acid anhydride and a polycarboxylic acid ester. Modified polyester resins, such as the prepolymer described above and resins obtained by cross-linking and/or elongating the prepolymer, do not fall within the crystalline polyester resin.

In the present embodiment, whether the crystalline polyester resin has crystallinity or not can be confirmed by a crystal analysis X-ray diffractometer (e.g., X'PERT PRO MRD from Koninklijke Philips N.V.). A measurement method is described below.

First, a target sample is ground by a mortar to prepare a sample powder, and the obtained sample powder is uniformly applied to a sample holder. The sample holder is set in the diffractometer, and a measurement is performed to obtain a diffraction spectrum. It is determined that the sample has crystallinity when the half value width of the diffraction peak having the highest peak intensity among the diffraction peaks observed in the range of $20° < 2\theta < 25°$ is 2.0 or less.

In the present embodiment, a polyester resin which does not satisfy this condition is referred to as an amorphous polyester resin in contrast to the crystalline polyester resin.

Exemplary measurement conditions for X-ray diffraction are described below.

Measurement Conditions
Tension kV: 45 kV
Current: 40 mA
MPSS
Upper
Gonio
Scanmode: continuos
Start angle: 3°
End angle: 35°
Angle Step: 0.02°
Lucident beam optics
Divergence slit: Div slit 1/2
Diffraction beam optics
Anti scatter slit: As Fixed 1/2
Receiving slit: Prog rec slit Polyol The polyol is not particularly limited and may be appropriately selected depending on the purpose. Examples of the polyol include, but are not limited to, diols and alcohols having a valence of 3 or more.

Examples of the diols include, but are not limited to, saturated aliphatic diols. Examples of the saturated aliphatic diols include, but are not limited to, straight-chain saturated aliphatic diols and branched saturated aliphatic diols. In particular, straight-chain saturated aliphatic diols are preferable, and straight-chain saturated aliphatic diols having 2 to 12 carbon atoms are more preferable. The branched saturated aliphatic diols may reduce crystallinity of the crystalline polyester resin and further reduce the melting point thereof. Saturated aliphatic diols having more than 12 carbon atoms are not easily available. Thus, preferably, the number of carbon atoms is 12 or less. Specific examples of the saturated aliphatic diols include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among these diols, ethylene glycol, 1,4-butanediol, 1,6-hexanediol, 1,8-octanediol, 1,10-decanediol, and 1,12-dodecanediol are preferable for obtaining a crystalline polyester resin having high crystallinity and sharply-melting property.

Specific examples of the alcohols having a valence of 3 or more include, but are not limited to, glycerin, trimethylolethane, trimethylolpropane, and pentaerythritol. Each of these compounds can be used alone or in combination with others.

Polycarboxylic Acid

The polycarboxylic acid is not particularly limited and may be appropriately selected according to the purpose. Examples of the polycarboxylic acid include, but are not limited to, divalent carboxylic acids and carboxylic acids having a valence of 3 or more.

Specific examples of the divalent carboxylic acids include, but are not limited to, saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids such as diprotic acids such as phthalic acid, isophthalic acid, terephthalic acid, naphthalene-2,6-dicarboxylic acid, malonic acid, and mesaconic acid; and anhydrides and lower alkyl esters (C1-C3) thereof.

Specific examples of the carboxylic acids having a valence of 3 or more include, but are not limited to, 1,2,4-benzenetricarboxylic acid, 1,2,5-benzenetricarboxylic acid, 1,2,4-naphthalenetricarboxylic acid, and anhydrides and lower alkyl esters (C1-C3) thereof.

The polycarboxylic acid may further include a dicarboxylic acid having sulfonic acid group, other than the above-described saturated aliphatic dicarboxylic acids and aromatic dicarboxylic acids. In addition, the polycarboxylic acid may further include a dicarboxylic acid having a double bond, other than the above-described saturated aliphatic dicarboxylic acids and aromatic dicarboxylic acids. Each of these compounds can be used alone or in combination with others.

Preferably, the crystalline polyester resin comprises a straight-chain saturated aliphatic dicarboxylic acid having 4 to 12 carbon atoms and a straight-chain saturated aliphatic diol having 2 to 12 carbon atoms. In other words, preferably, the crystalline polyester resin has a structural unit derived from a saturated aliphatic dicarboxylic acid having 4 to 12 carbon atoms and another structural unit derived from a saturated aliphatic diol having 2 to 12 carbon atoms. Such a crystalline polyester resin has high crystallinity and sharply-melting property and thus exerts excellent low-temperature fixability, which is preferable.

The melting point of the crystalline polyester resin is not particularly limited and may be appropriately selected according to the purpose, but is preferably in the range of from 60° C. to 80° C. When the melting point is less than 60° C., the crystalline polyester resin easily melts at low temperatures, resulting in poor heat-resistant storage stability of the toner. When the melting point is higher than 80° C., the crystalline polyester resin insufficiently melts even when heated at the time of fixing the toner, resulting in poor low-temperature fixability.

The molecular weight of the crystalline polyester resin is not particularly limited and may be appropriately selected depending on the purpose. As the molecular weight distribution becomes narrower and the molecular weight becomes lower, low-temperature fixability improves. As the amount of low-molecular-weight components increases, heat-resistant storage stability deteriorates. In view of this, preferably, ortho-dichlorobenzene-soluble matter in the crystalline polyester resin has a weight average molecular weight (Mw) of from 3,000 to 30,000 and a number average molecular weight (Mn) of from 1,000 to 10,000, and a ratio Mw/Mn of from 1.0 to 10, when measured by GPC (gel permeation chromatography). More preferably, the weight average molecular weight (Mw) is from 5,000 to 15,000, the number average molecular weight (Mn) is from 2,000 to 10,000, and the ratio Mw/Mn is from 1.0 to 5.0.

The acid value of the crystalline polyester resin is not particularly limited and may be appropriately selected according to the purpose, but is preferably 5 mgKOH/g or more, more preferably 10 mgKOH/g or more, for achieving a desired level of low-temperature fixability in terms of affinity for paper. On the other hand, for improving high-temperature offset resistance, the acid value is preferably 45 mgKOH/g or less.

The hydroxyl value of the crystalline polyester resin is not particularly limited and may be appropriately selected according to the purpose, but is preferably in the range of from 0 to 50 mgKOH/g, more preferably from 5 to 50 mgKOH/g, for achieving a desired level of low-temperature fixability and a good level of charge property.

The molecular structure of the crystalline polyester resin can be determined by, for example, solution or solid NMR (nuclear magnetic resonance), X-ray diffractometry, GC/MS (gas chromatography-mass spectroscopy), LC/MS (liquid chromatography-mass spectroscopy), or IR (infrared spectroscopy). For example, IR can simply detect a crystalline polyester resin as a substance showing an absorption peak based on 6CH (out-of-plane bending vibration) of olefin at 965±10 $cm^{-1}$ or 990±10 $cm^{-1}$ in an infrared absorption spectrum.

The content of the crystalline polyester resin is not particularly limited and may be appropriately selected according to the purpose. Preferably, the content of the crystalline polyester resin in 100 parts by mass of the toner is in the range of from 1 to 10 parts by mass, more preferably from 2 to 4 parts by mass. When the content is less than 1 part by mass, sharply-melting property of the crystalline polyester resin may be insufficient, resulting in poor low-temperature fixability. When the content is larger than 10 parts by mass, heat-resistant storage stability may be poor and image fog may occur. When the content is within the preferred range, all properties such as image quality and low-temperature fixability are excellent.

Colorant

The colorant is not particularly limited and may be appropriately selected depending on the purpose.

Specific examples of the colorant include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. The content of the colorant is not particularly limited and may be appropriately selected according to the purpose. Preferably, the content of the colorant in 100 parts by mass of the toner is in the range of from 1 to 15 parts by mass, more preferably from 3 to 10 parts by mass.

The colorant can be combined with a resin to be used as a master batch. Specific examples of the resin to be used for the master batch include, but are not limited to, the above-described other polyester resin, polymers of styrene or a derivative thereof (e.g., polystyrene, poly-p-chlorostyrene, polyvinyl toluene), styrene-based copolymers (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax.

Each of these compounds can be used alone or in combination with others. The master batch can be obtained by mixing and kneading the resin and the colorant while applying a high shearing force thereto. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. Preferably, the mixing and kneading is performed by a high shearing dispersing device such as a three roll mill.

Charge Control Agent

The charge control agent is not particularly limited and may be appropriately selected depending on the purpose. Specific examples of the charge control agent include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives.

Specific examples of commercially available charge control agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), available from Orient Chemical Industries Co., Ltd.; TP-302 and TP-415 (molybdenum complexes of quaternary ammonium salts), available from Hodogaya Chemical Co., Ltd.; LRA-901, and LR-147 (boron complex), all available from Japan Carlit Co., Ltd.; and cooper phthalocyanine, perylene, quinacridone, azo pigments, and polymers having a functional group such as a sulfonic acid group, a carboxyl group, and a quaternary ammonium group.

Preferably, the content of the charge control agent in 100 parts by mass of the toner is in the range of from 0.1 to 10 parts by mass, more preferably from 0.2 to 5 parts by mass.

Additive

As the additive, two or more types of inorganic fine particles are preferably added, and one or more types thereof are silica. It is possible to suitably select a combination of multiple known additives according to the purpose. Specific examples of the additive include, but are not limited to, hydrophobized silica fine particles, metal salts of fatty acids (e.g., zinc stearate, aluminum stearate), metal oxides (e.g., titania, alumina, tin oxide, antimony oxide) and hydrophobized products thereof, and fluoropolymers. Among these, hydrophobized silica fine particles, titania fine particles, and hydrophobized titania fine particles are preferable.

Specific examples of commercially-available hydrophobized silica fine particles include, but are not limited to, HDK H2000T, HDK H2000/4, HDK H2050EP, HVK21, and FMK H1303 (available from Clariant (Japan) K.K.); and R972, R974, RX200, RY200, R202, R805, R812, and NX90G (available from Nippon Aerosil Co., Ltd.).

Specific examples of commercially-available titania fine particles include, but are not limited to, P-25 (available from Nippon Aerosil Co., Ltd.); STT-30 and STT-65C-S (available from Titan Kogyo, Ltd.); TAF-140 (available from Fuji Titanium Industry Co., Ltd.); and MT-150W, MT-500B, MT-600B, and MT-150A (available from TAYCA Corporation).

Specific examples of commercially-available hydrophobized titania fine particles include, but are not limited to, T-805 (available from Nippon Aerosil Co., Ltd.); STT-30A and STT-65S-S (available from Titan Kogyo, Ltd.); TAF-500T and TAF-1500T (available from Fuji Titanium Industry Co., Ltd.); MT-100S, MT-100T, and MT-150AFM (available from TAYCA Corporation); and IT-S (available from Ishihara Sangyo Kaisha, Ltd.).

Calculation Methods and Analysis Methods of Various Properties of Toner and Toner Constituents Next, calculation methods and analysis methods of various properties of the toner and toner constituents are described below. Various properties such as glass transition temperature (Tg), acid value, hydroxyl value, molecular weight, and melting point of toner constituents, such as the polyester resin components A, B, and C, the crystalline polyester resin, and the release agent, may be measured from the single body thereof. Alternatively, such properties may be measured from each constituent separated (isolated) from the toner by means of Soxhlet extraction, gel permeation chromatography (GPC), or the like. In the present embodiment, a means for separating each constituent from the toner can be arbitrarily selected. The glass transition temperature (Tg) of a target sample is measured by a method described later.

As an example, a method for measuring the glass transition temperatures of the polyester resin component A, polyester resin component B, and polyester resin component C in the toner is described below. First, 1 g of the toner is put in 100 mL of THF and subjected to Soxhlet extraction to obtain THF-soluble matter and THF-insoluble matter. The THF-soluble matter and the THF-insoluble matter are dried in a vacuum dryer for 24 hours, thus obtaining a mixture of the polyester resin component C and the crystalline polyester resin component from the THF soluble matter and a mixture of the polyester resin component A and the polyester resin component B from the THF-insoluble matter. The glass transition temperatures are measured by the method described later from these mixtures, i.e., target samples.

Since the polyester resin component A and the polyester resin component B have different glass transition temperatures, the glass transition temperature of each of the polyester resin component A and the polyester resin component B can be determined by measuring the glass transition temperature of the above-obtained mixture of the polyester resin component A and the polyester resin component B.

As another example, first, 1 g of the toner is put in 100 mL of THF and stirred at 25° C. for 30 minutes to obtain a solution in which THF-soluble matter is dissolved. The solution is filtered with a membrane filter having an opening of 0.2 μm to separate (isolate) THF-soluble matter from the toner. The THF-soluble matter is dissolved in THF to prepare a sample for GPC measurement. The sample is injected into a GPC instrument for measuring the molecular weight of the polyester resin component C. On the other hand, THF-insoluble matter in the toner is used as a sample for measuring the molecular weights of the polyester resin component A and the polyester resin component B by GPC.

A fraction collector, disposed at the eluate discharge port of the GPC instrument, collects a fraction of the eluate at every predetermined count. Every time the collected fractions correspond to 5% of the area of the elution curve (from the rising of the curve), the collected fractions are separated. Each separated eluate in an amount of 30 mg is dissolved in 1 mL of deuterated chloroform. As a standard substance, 0.05% by volume of tetramethylsilane (TMS) is further added thereto. The resulting solution is poured in a glass tube having a diameter of 5 mm and subjected to an NMR measurement using a nuclear magnetic resonance spectrometer (JNM-AL400 available from JEOL Ltd.) to obtain a spectrum. The measurement is performed at a temperature of from 23° C. to 25° C., and the number of accumulation is 128. The monomer composition and constitutional ratio of the toner constituents, such as the polyester resin components A, B, and C and the crystalline polyester resin, can be determined from the peak integral ratio of the spectrum.

Next, a method for separating each constituent by GPC is described below. In a GPC measurement using THF as a mobile phase, the eluate is divided into fractions by a fraction collector, and the fractions corresponding to the desired molecular weight portion in the total area of the elution curve are collected. The collected fractions of the eluate are condensed and dried by an evaporator or the like. The resulting solid is dissolved in a deuterated solvent, such as deuterated chloroform or deuterated THF, and subjected to $^{1}$H-NMR measurement to determine integrated ratio of each element and calculate the constitutional monomer ratio in the eluted components. Alternatively, the constitutional monomer ratio may be determined by hydrolyzing the condensed eluate with sodium hydroxide or the like, and subjecting the decomposition product to a qualitative quantitative analysis by high-performance liquid chromatography (HPLC).

In a case in which the toner is produced by a method including the process of forming a polyester resin by causing an elongation reaction and/or a cross-linking reaction between a non-linear reactive precursor and a curing agent while forming mother toner particles, the polyester resin may be separated from the toner by GPC or the like to determine Tg or the like from the separated polyester resin. Alternatively, the polyester resin may be previously synthesized by causing an elongation reaction and/or a cross-linking reaction between a non-linear reactive precursor and a curing agent, and the properties such as Tg may be determined from the synthesized polyester resin.

Measurement Methods of Melting Point and Glass Transition Temperature (Tg)

In the present embodiment, melting points and glass transition temperatures (Tg) are measured with a DSC (differential scanning calorimeter) system (Q-200 available from TA Instruments).

More specifically, melting points and glass transition temperatures (Tg) are measured in the following manner.

First, about 5.0 mg of a sample is put in an aluminum sample container. The sample container is put on a holder unit and set in an electric furnace. The temperature is raised from −80° C. to 150° C. at a temperature rising rate of 10° C./min ("first heating") in nitrogen atmosphere. The temperature is thereafter lowered from 150° C. to −80° C. at a temperature falling rate of 10° C./min and raised to 150° C. again at a temperature rising rate of 10° C./min ("second heating"). In each of the first heating and the second heating, a DSC curve is obtained by the differential scanning calorimeter (Q-200 available from TA Instruments).

Figure 7:
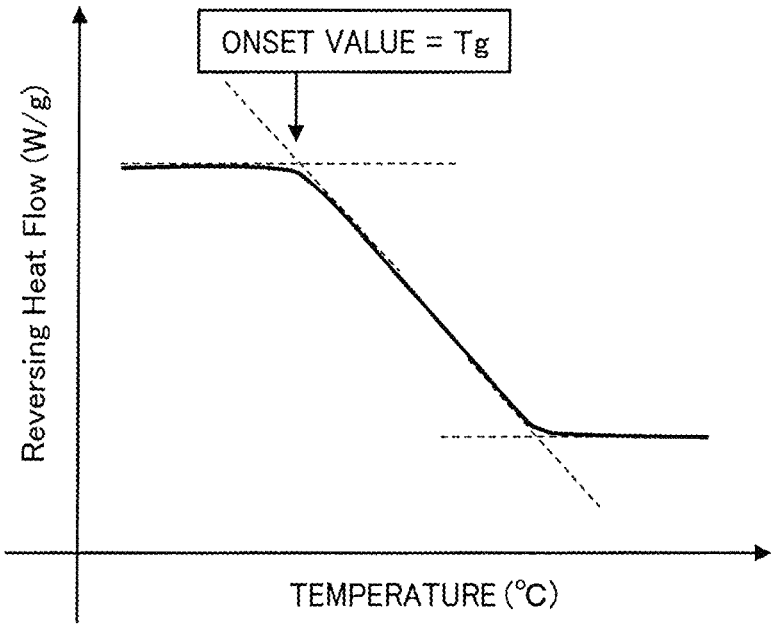
FIG. 7 is a diagram for explaining Tg.

The obtained DSC curves are analyzed with an analysis program installed in Q-200. By selecting the DSC curve obtained in the first heating, a glass transition temperature $Tg_{1st}$ of the target sample in the first heating can be determined. Similarly, by selecting the DSC curve obtained in the second heating, a glass transition temperature $Tg_{2nd}$ of the target sample in the second heating can be determined. The onset value illustrated in FIG. 7 is taken as Tg.

The THF-insoluble matter of the toner is preferably subject to a measurement procedure described below in which the temperature is raised with a modulation temperature amplitude. This measurement procedure makes it possible to separate the glass transition temperature ($Tg_{1st}$) in the first heating into two portions.

Measurement Conditions

Using modulation mode, the temperature is raised from −80° C. to 150° C. at a temperature rising rate of 1.0° C./min ("first heating") with a modulation temperature amplitude of ±1.0° C./min. The temperature is thereafter lowered from 150° C. to −80° C. at a temperature falling rate of 10° C./min and raised to 150° C. again at a temperature rising rate of 1.0° C./min ("second heating").

The obtained DSC curves are analyzed with an analysis program installed in Q-200 on the ordinate with "Reversing Heat Flow" as the vertical axis, and the onset value illustrated in FIG. 7 is taken as Tg.

In addition, by selecting the DSC curve obtained in the first heating with an analysis program installed in Q-200, an endothermic peak temperature in the first heating can be determined as a melting point in the first heating. Similarly, by selecting the DSC curve obtained in the second heating, an endothermic peak temperature in the second heating can be determined as a melting point in the second heating.

In the present disclosure, the melting point and the glass transition temperature Tg of each toner constituent, such as the polyester resin components A, B, and C and the release agent, are the endothermic peak temperature and the glass transition temperature $Tg_{2nd}$, respectively, each measured in the second heating, unless otherwise specified.

Method for Producing Toner

A method for producing the toner is not particularly limited and may be appropriately selected according to the purpose. Preferably, the toner is produced by dispersing an oil phase in an aqueous medium. Here, the oil phase contains the release agent and a polyester resin having neither urethane bond nor urea bond, preferably a polyester resin prepolymer having urethane bond and/or urea bond, as the polyester resin component, and optionally the curing agent, the colorant, and the like.

As an example of such a method for producing toner, a dissolution suspension method is known.

As an example thereof, one method is described below that forms mother toner particles while forming a polyester resin by an elongation reaction and/or a cross-linking reaction between the prepolymer and the curing agent.

This method involves the processes of preparation of an aqueous medium, preparation of an oil phase containing toner constituents, emulsification or dispersion of the toner constituents, and removal of an organic solvent.

Preparation of Aqueous Medium (Aqueous Phase)

In the aqueous medium, resin particles are dispersed. The amount of the resin particles added in the aqueous medium is not particularly limited and may be appropriately selected according to the purpose, but is preferably in the range of from 0.5 to 10 parts by mass based on 100 parts of the aqueous medium.

Specific examples of the aqueous medium include, but are not limited to, water, water-miscible solvents, and mixtures thereof. Each of these media can be used alone or in combination with others. Among these, water is preferable.

The water-miscible solvent is not particularly limited and may be appropriately selected according to the purpose. Specific examples of the water-miscible solvents include, but are not limited to, alcohols, dimethylformamide, tetrahydrofuran, cellosolves, and lower ketones. Specific examples of the alcohols include, but are not limited to, methanol, isopropanol, and ethylene glycol. Specific examples of the lower ketones include, but are not limited to, acetone and methyl ethyl ketone.

Preparation of Oil Phase

The oil phase may be prepared by dissolving or dispersing toner constituents in an organic solvent, where the toner constituents include the polyester resin having neither urethane bond nor urea bond and the release agent, and optionally the polyester resin prepolymer having urethane bond and/or urea bond, the curing agent, the colorant, and the like.

The organic solvent is not particularly limited and may be appropriately selected according to the purpose, but preferred is an organic solvent having a boiling point less than 150° C. that is easy to remove.

Specific examples of the organic solvent having a boiling point less than 150° C. include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone.

Each of these solvents can be used alone or in combination with others.

Among these solvents, ethyl acetate, toluene, xylene, benzene, methylene chloride, 1,2-dichloroethane, chloroform, and carbon tetrachloride are preferable, and ethyl acetate is most preferable.

Emulsification or Dispersion

Emulsification or dispersion of the toner constituents is conducted by dispersing the oil phase containing the toner constituents in the aqueous medium. At the time of emulsification or dispersion of the toner constituents, the curing agent and the prepolymer may undergo an elongation reaction and/or a cross-linking reaction.

The reaction conditions (e.g., reaction time, reaction temperature) for forming the prepolymer are not particularly limited and can be appropriately determined depending on the combination of the curing agent and the prepolymer. Preferably, the reaction time is in the range of from 10 minutes to 40 hours, more preferably from 2 to 24 hours. Preferably, the reaction temperature is in the range of from 0° C. to 150° C., more preferably from 40° C. to 98° C.

A method for stably forming a dispersion liquid containing the prepolymer in the aqueous medium is not particularly limited and may be appropriately selected depending on the purpose. As an example, the dispersion liquid can be prepared by dispersing the oil phase, in which the toner constituents are dissolved or dispersed in a solvent, in the aqueous medium by a shear force.

A disperser for the dispersing is not particularly limited and may be appropriately selected depending on the purpose. Examples of the disperser include, but are not limited to, low-speed shearing type dispersers, high-speed shearing type dispersers, friction type dispersers, high-pressure jet type dispersers, and ultrasonic dispersers. Among these dispersers, high-speed shearing type dispersers are preferable because they can adjust the particle diameter of the dispersoids (oil droplets) to 2 to 20 μm.

When a high-speed shearing type disperser is used, dispersing conditions, such as the number of rotation, dispersing time, and dispersing temperature, are determined depending on the purpose. The rotation speed is preferably in the range of from 1,000 to 30,000 rpm, and more preferably from 5,000 to 20,000 rpm. The dispersing time is preferably in the range of from 0.1 to 5 minutes in the case of batch-type disperser. The dispersing temperature is preferably in the range of from 0° C. to 150° C., more preferably from 40° C. to 98° C., under pressure. Generally, as the dispersing temperature becomes higher, the dispersing becomes easier.

The amount of the aqueous medium used in emulsifying or dispersing the toner material is not particularly limited and may be appropriately selected according to the purpose, but is preferably in the range of from 50 to 2,000 parts by mass, more preferably from 100 to 1,000 parts by mass, based on 100 parts by mass of the toner constituents.

When emulsifying or dispersing the oil phase containing the toner constituents, it is preferable to use a dispersing agent for stabilizing the dispersoids such as oil droplets, making them into a desired shape, and sharpening the particle size distribution thereof.

The dispersant is not particularly limited and may be appropriately selected depending on the purpose. Specific examples of the dispersant include, but are not limited to, surfactants, poorly-water-soluble inorganic compounds, and polymeric protection colloids. Each of these compounds can be used alone or in combination with others. Among these, surfactants are preferable.

The surfactants are not particularly limited and may be appropriately selected according to the purpose. Examples of the surfactants include, but are not limited to, anionic surfactants, cationic surfactants, nonionic surfactants, and ampholytic surfactants. Specific examples of the anionic surfactants include, but are not limited to, alkylbenzene sulfonate, α-olefin sulfonate, and phosphate. Among these surfactants, those having a fluoroalkyl group are preferred.

Removal of Organic Solvent

A method for removing the organic solvent from the dispersion liquid such as an emulsion slurry is not particularly limited and may be appropriately selected depending on the purpose. For example, the method may include gradually raising the temperature of the reaction system to completely evaporate the organic solvent from oil droplets, or spraying the dispersion liquid into dry atmosphere to completely evaporate the organic solvent from oil droplets.

As the organic solvent has been removed, mother toner particles are formed. The mother toner particles are washed and dried, and optionally classified by size. The classification may be performed in a liquid by removing the additives by cyclone separation, decantation, or centrifugal separation. Alternatively, the classification may be performed after the mother toner particles have been dried.

The mother toner particles may be further mixed with the particulate external additives, charge control agents, etc. By applying a mechanical impact in the mixing, the particulate external additives, etc. are suppressed from releasing from the surface of the mother toner particles.

A method for applying the mechanical impact is not particularly limited and may be appropriately selected depending on the purpose. For example, the method may include applying a mechanical impulsive force to the mixture using blades rotating at a high speed, or accelerating the mixture in a high-speed airflow to allow the particles collide with each other or a collision plate.

An apparatus used for the above method is not particularly limited and may be appropriately selected depending on the purpose. Examples of usable apparatuses include, but are not limited to, ONG MILL (available from Hosokawa Micron Co., Ltd.), I-TYPE MILL (available from Nippon Pneumatic Mfg. Co., Ltd.) modified to reduce the pulverizing air pressure, HYBRIDIZATION SYSTEM (from Nara Machine Co., Ltd.), KRYPTON SYSTEM (from Kawasaki Heavy Industries, Ltd.), and an automatic mortar.

EXAMPLES

The embodiments of the present invention is further described in detail with reference to the Examples but is not limited to the following Examples. In the descriptions in the following examples, "parts" represents mass ratios in parts and "%" represents "% by mass", unless otherwise specified. Some of the Examples presented below are prophetic and contain estimated results. Specifically, Examples 3 and 6-8 were not actually performed and contain estimated results.

Production Example 1

Preparation of Toner 1

Production Example A-1

Synthesis of Prepolymer A-1 (Amorphous Polyester Resin A-1)

A reaction vessel equipped with a cooling tube, a stirrer, and a nitrogen introducing tube was charged with diol components comprising 100% by mol of 3-methyl-1,5-pentanediol, dicarboxylic acid components comprising 40% by mol of isophthalic acid and 60% by mol of adipic acid, and 1% by mol (based on all monomers) of trimellitic anhydride, along with 1,000 ppm (based on the resin components) of titanium tetraisopropoxide, such that the molar ratio (OH/COOH) of hydroxyl groups to carboxyl groups became 1.5.

The vessel contents were heated to 200° C. over a period of about 4 hours, thereafter heated to 230° C. over a period of 2 hours, and the reaction was continued until outflow water was no more produced.

The vessel contents were further allowed to react under reduced pressures of from 10 to 15 mmHg for 5 hours. Thus, an intermediate polyester A-1 was prepared.

Next, in a reaction vessel equipped with a cooling tube, a stirrer, and a nitrogen introducing tube, the intermediate polyester A-1 and isophorone diisocyanate (IPDI) were contained such that the molar ratio of isocyanate groups in IPDI to hydroxyl groups in the intermediate polyester became 2.0. The vessel contents were diluted with ethyl acetate to become a 50% ethyl acetate solution and further allowed to react at 100° C. for 5 hours.

Thus, a prepolymer A-1 was prepared.

In Examples and Comparative Examples described below, the prepolymer A-1 is formed into a polyester resin component A-1, corresponding to the polyester resin component A, in the process of preparing a toner. (This also applies to each of Production Examples A and B).

Production Example A-2

Synthesis of Prepolymer A-2 (Amorphous Polyester Resin A-2)

A reaction vessel equipped with a cooling tube, a stirrer, and a nitrogen introducing tube was charged with diol components comprising 100% by mol of 3-methyl-1,5-pentanediol, dicarboxylic acid components comprising 33% by mol of isophthalic acid and 67% by mol of adipic acid, and 1% by mol (based on all monomers) of trimellitic anhydride, along with 1,000 ppm (based on the resin components) of titanium tetraisopropoxide, such that the molar ratio (OH/COOH) of hydroxyl groups to carboxyl groups became 1.5.

The vessel contents were heated to 200° C. over a period of about 4 hours, thereafter heated to 230° C. over a period of 2 hours, and the reaction was continued until outflow water was no more produced.

The vessel contents were further allowed to react under reduced pressures of from 10 to 15 mmHg for 5 hours. Thus, an intermediate polyester A-2 was prepared.

Next, in a reaction vessel equipped with a cooling tube, a stirrer, and a nitrogen introducing tube, the intermediate polyester A-2 and isophorone diisocyanate (IPDI) were contained such that the molar ratio of isocyanate groups in IPDI to hydroxyl groups in the intermediate polyester became 2.0. The vessel contents were diluted with ethyl acetate to become a 50% ethyl acetate solution and further allowed to react at 100° C. for 5 hours. Thus, a prepolymer A-2 was prepared.

Production Example A-3

Synthesis of Prepolymer A-3 (Amorphous Polyester Resin A-3)

A reaction vessel equipped with a cooling tube, a stirrer, and a nitrogen introducing tube was charged with diol components comprising 100% by mol of 3-methyl-1,5-pentanediol, dicarboxylic acid components comprising 67% by mol of isophthalic acid and 33% by mol of adipic acid, and 1% by mol (based on all monomers) of trimellitic anhydride, along with 1,000 ppm (based on the resin components) of titanium tetraisopropoxide, such that the molar ratio (OH/COOH) of hydroxyl groups to carboxyl groups became 1.5.

The vessel contents were heated to 200° C. over a period of about 4 hours, thereafter heated to 230° C. over a period of 2 hours, and the reaction was continued until outflow water was no more produced.

The vessel contents were further allowed to react under reduced pressures of from 10 to 15 mmHg for 5 hours. Thus, an intermediate polyester A-3 was prepared.

Next, in a reaction vessel equipped with a cooling tube, a stirrer, and a nitrogen introducing tube, the intermediate polyester A-3 and isophorone diisocyanate (IPDI) were contained such that the molar ratio of isocyanate groups in IPDI to hydroxyl groups in the intermediate polyester became 2.0. The vessel contents were diluted with ethyl acetate to become a 50% ethyl acetate solution and further allowed to react at 100° C. for 5 hours. Thus, a prepolymer A-3 was prepared.

Production Example B-1

Synthesis of Prepolymer B-1 (Amorphous Polyester Resin B-1)

A reaction vessel equipped with a cooling tube, a stirrer, and a nitrogen introducing tube was charged with diol components comprising 80% by mol of ethylene oxide 2 mol adduct of bisphenol A and 20% by mol of propylene oxide 2 mol adduct of bisphenol A and dicarboxylic acid components comprising 60% by mol of terephthalic acid and 40% by mol of adipic acid, along with 1,000 ppm (based on the resin components) of titanium tetraisopropoxide, such that the molar ratio (OH/COOH) of hydroxyl groups to carboxyl groups became 1.1. The vessel contents were heated to 200° C. over a period of about 4 hours, thereafter heated to 230° C. over a period of 2 hours, and the reaction was continued until outflow water was no more produced. The vessel contents were further allowed to react under reduced pressures of from 10 to 15 mmHg for 5 hours. Thus, an intermediate polyester B-1 was prepared.

Next, in a reaction vessel equipped with a cooling tube, a stirrer, and a nitrogen introducing tube, the intermediate polyester B-1 and isophorone diisocyanate (IPDI) were contained such that the molar ratio of isocyanate groups in IPDI to hydroxyl groups in the intermediate polyester became 2.0. The vessel contents were diluted with ethyl acetate to become a 50% ethyl acetate solution and further allowed to react at 100° C. for 5 hours. Thus, a prepolymer B-1 was prepared.

Production Example B-2

Synthesis of Prepolymer B-2 (Amorphous Polyester Resin B-2)

A reaction vessel equipped with a cooling tube, a stirrer, and a nitrogen introducing tube was charged with diol components comprising 80% by mol of ethylene oxide 2 mol adduct of bisphenol A and 20% by mol of propylene oxide 2 mol adduct of bisphenol A and dicarboxylic acid components comprising 30% by mol of terephthalic acid and 70% by mol of adipic acid, along with 1,000 ppm (based on the resin components) of titanium tetraisopropoxide, such that the molar ratio (OH/COOH) of hydroxyl groups to carboxyl groups became 1.1. The vessel contents were heated to 200° C. over a period of about 4 hours, thereafter heated to 230° C. over a period of 2 hours, and the reaction was continued until outflow water was no more produced. The vessel contents were further allowed to react under reduced pressures of from 10 to 15 mmHg for 5 hours. Thus, an intermediate polyester B-2 was prepared.

Next, in a reaction vessel equipped with a cooling tube, a stirrer, and a nitrogen introducing tube, the intermediate polyester B-2 and isophorone diisocyanate (IPDI) were contained such that the molar ratio of isocyanate groups in IPDI to hydroxyl groups in the intermediate polyester became 2.0. The vessel contents were diluted with ethyl acetate to become a 50% ethyl acetate solution and further allowed to react at 100° C. for 5 hours. Thus, a prepolymer B-2 was prepared.

Production Example B-3

Synthesis of Prepolymer B-3 (Amorphous Polyester Resin B-3)

A reaction vessel equipped with a cooling tube, a stirrer, and a nitrogen introducing tube was charged with diol components comprising 80% by mol of ethylene oxide 2 mol adduct of bisphenol A and 20% by mol of propylene oxide 2 mol adduct of bisphenol A and dicarboxylic acid components comprising 80% by mol of terephthalic acid and 20% by mol of adipic acid, along with 1,000 ppm (based on the resin components) of titanium tetraisopropoxide, such that the molar ratio (OH/COOH) of hydroxyl groups to carboxyl groups became 1.1. The vessel contents were heated to 200° C. over a period of about 4 hours, thereafter heated to 230° C. over a period of 2 hours, and the reaction was continued until outflow water was no more produced. The vessel contents were further allowed to react under reduced pressures of from 10 to 15 mmHg for 5 hours. Thus, an intermediate polyester B-3 was prepared.

Next, in a reaction vessel equipped with a cooling tube, a stirrer, and a nitrogen introducing tube, the intermediate polyester B-3 and isophorone diisocyanate (IPDI) were contained such that the molar ratio of isocyanate groups in IPDI to hydroxyl groups in the intermediate polyester became 2.0. The vessel contents were diluted with ethyl acetate to become a 50% ethyl acetate solution and further allowed to react at 100° C. for 5 hours. Thus, a prepolymer B-3 was prepared.

Production Example C-1

Synthesis of Amorphous Polyester Resin C-1

In a four-neck flask equipped with a nitrogen inlet tube, a dewatering tube, a stirrer, and a thermocouple, ethylene oxide 2-mol adduct of bisphenol A (BisA-EO) and propylene oxide 3-mol adduct of bisphenol A (BisA-PO) at a molar ratio (BisA-EO/BisA-PO) of 85/15, terephthalic acid and adipic acid at a molar ratio (terephthalic acid/adipic acid) of 75/25, and trimethylolpropane (TMP) in an amount of 1% by mol (based on all the monomers) were contained, such that the molar ratio (OH/COOH) of hydroxyl groups to carboxyl groups became 1.2. After adding 500 ppm of titanium tetraisopropoxide (based on the resin components) to the flask, the flask contents were allowed to react at 230° C. at normal pressures for 8 hours, and subsequently at reduced pressures of 10 to 15 mmHg for 4 hours. After further adding 1% by mol of trimellitic anhydride (based on all the resin components) to the flask, the flask contents were allowed to react at 180° C. at normal pressures for 3 hours. Thus, an amorphous polyester resin C-1 was prepared.

Production Example C-2

Synthesis of Amorphous Polyester Resin C-2

In a four-neck flask equipped with a nitrogen inlet tube, a dewatering tube, a stirrer, and a thermocouple, ethylene oxide 2-mol adduct of bisphenol A (BisA-EO) and propylene oxide 3-mol adduct of bisphenol A (BisA-PO) at a molar ratio (BisA-EO/BisA-PO) of 85/15, terephthalic acid and adipic acid at a molar ratio (terephthalic acid/adipic acid) of 65/35, and trimethylolpropane (TMP) in an amount of 1% by mol (based on all the monomers) were contained, such that the molar ratio (OH/COOH) of hydroxyl groups to carboxyl groups became 1.2. After adding 500 ppm of titanium tetraisopropoxide (based on the resin components) to the flask, the flask contents were allowed to react at 230° C. at normal pressures for 8 hours, and subsequently at reduced pressures of 10 to 15 mmHg for 4 hours. After further adding 1% by mol of trimellitic anhydride (based on all the resin components) to the flask, the flask contents were allowed to react at 180° C. at normal pressures for 3 hours. Thus, an amorphous polyester resin C-2 was prepared.

Production Example C-3

Synthesis of Amorphous Polyester Resin C-3

In a four-neck flask equipped with a nitrogen inlet tube, a dewatering tube, a stirrer, and a thermocouple, ethylene oxide 2-mol adduct of bisphenol A (BisA-EO) and propylene oxide 3-mol adduct of bisphenol A (BisA-PO) at a molar ratio (BisA-EO/BisA-PO) of 85/15, terephthalic acid and adipic acid at a molar ratio (terephthalic acid/adipic acid) of 85/15, and trimethylolpropane (TMP) in an amount of 1% by mol (based on all the monomers) were contained, such that the molar ratio (OH/COOH) of hydroxyl groups to carboxyl groups became 1.2. After adding 500 ppm of titanium tetraisopropoxide (based on the resin components) to the flask, the flask contents were allowed to react at 230° C. at normal pressures for 8 hours, and subsequently at reduced pressures of 10 to 15 mmHg for 4 hours. After further adding 1% by mol of trimellitic anhydride (based on all the resin components) to the flask, the flask contents were allowed to react at 180° C. at normal pressures for 3 hours. Thus, an amorphous polyester resin C-3 was prepared.

Production Example C-4

Synthesis of Amorphous Polyester Resin C-4

In a four-neck flask equipped with a nitrogen inlet tube, a dewatering tube, a stirrer, and a thermocouple, ethylene oxide 2-mol adduct of bisphenol A (BisA-EO) and propylene oxide 3-mol adduct of bisphenol A (BisA-PO) at a molar ratio (BisA-EO/BisA-PO) of 85/15, terephthalic acid and adipic acid at a molar ratio (terephthalic acid/adipic acid) of 60/40, and trimethylolpropane (TMP) in an amount of 1% by mol (based on all the monomers) were contained, such that the molar ratio (OH/COOH) of hydroxyl groups to carboxyl groups became 1.2. After adding 500 ppm of titanium tetraisopropoxide (based on the resin components) to the flask, the flask contents were allowed to react at 230° C. at normal pressures for 8 hours, and subsequently at reduced pressures of 10 to 15 mmHg for 4 hours. After further adding 1% by mol of trimellitic anhydride (based on all the resin components) to the flask, the flask contents were allowed to react at 180° C. at normal pressures for 3 hours. Thus, an amorphous polyester resin C-4 was prepared.

Production Example D-1

Synthesis of Crystalline Polyester Resin D-1

A 5-L four-neck flask equipped with a nitrogen inlet tube, a dewatering tube, a stirrer, and a thermocouple, dodecanedioic acid and 1,6-hexanediol were contained such that the molar ratio (OH/COOH) of hydroxyl groups to carboxyl groups became 0.9. After adding 500 ppm (based on the resin components) of titanium tetraisopropoxide to the flask, the flask contents were allowed to react at 180° C. for 10 hours, thereafter at 200° C. for 3 hours, and further under a pressure of 8.3 kPa for 2 hours. Thus, a crystalline polyester resin D-1 was prepared.

Preparation of Crystalline Polyester Resin Dispersion Liquid

In a vessel equipped with a stirrer and a thermometer, 50 parts of the crystalline polyester resin D-1 and 450 parts of ethyl acetate were contained and heated to 80° C. while being stirred, maintained at 80° C. for 5 hours, and cooled to 30° C. over a period of 1 hour. The resulting liquid was thereafter subjected to a dispersion treatment using a bead mill (ULTRAVISCOMILL available from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Thus, a crystalline polyester resin dispersion liquid 1 was prepared.

Preparation of Master Batch

First, 1,200 parts of water, 500 parts of a carbon black (PRINTEX 35 available from Degussa, having a DBP oil absorption of 42 mL/100 mg and a pH of 9.5), and 500 parts of the amorphous polyester resin C-1 were mixed with a HENSCHEL MIXER (manufactured Mitsui Mining and Smelting Co., Ltd.). The mixture was kneaded with a double roll at 150° C. for 30 minutes, thereafter rolled to cool, and pulverized with a pulverizer. Thus, a master batch 1 was prepared.

Preparation of Wax Dispersion Liquid

In a vessel equipped with a stirrer and a thermometer, 50 parts of a paraffin wax (HNP-9 available from NIPPON SEIRO CO., LTD., a hydrocarbon wax having a melting point of 75° C. and a solubility parameter (SP) of 8.8), serving as a release agent 1, and 450 parts of ethyl acetate were contained and heated to 80° C. while being stirred, maintained at 80° C. for 5 hours, and cooled to 30° C. over a period of 1 hour. The resulting liquid was thereafter subjected to a dispersion treatment using a bead mill (ULTRAVISCOMILL available from Aimex Co., Ltd.) filled with 80% by volume of zirconia beads having a diameter of 0.5 mm, at a liquid feeding speed of 1 kg/hour and a disc peripheral speed of 6 m/sec. This dispersing operation was repeated 3 times (3 passes). Thus, a wax dispersion liquid 1 was prepared.

Synthesis of Ketimine Compound

In a reaction vessel equipped with a stirrer and a thermometer, 170 parts of isophoronediamine and 75 parts of methyl ethyl ketone were contained and allowed to react at 50° C. for 5 hours. Thus, a ketimine compound 1 was prepared.

The ketimine compound 1 had an amine value of 418.

Preparation of Oil Phase

In a vessel, 500 parts of the wax dispersion liquid 1, 76 parts of the prepolymer A-1, 152 parts of the prepolymer B-1, 836 parts of the amorphous polyester resin C-1, 100 parts of the master batch 1, and 2 parts of the ketimine compound 1 as a curing agent were mixed with a TK HOMOMIXER (available from PRIMIX Corporation) at a revolution of 7,000 rpm for 60 minutes. Thus, an oil phase 1 was prepared.

Preparation of Organic Fine Particle Emulsion (Fine Particle Dispersion Liquid)

In a reaction vessel equipped with a stirrer and a thermometer, 683 parts of water, 11 parts of a sodium salt of a sulfate of ethylene oxide adduct of methacrylic acid (ELEMINOL RS-30 available from Sanyo Chemical Industries, Ltd.), 138 parts of styrene, 138 parts of methacrylic acid, and 1 part of ammonium persulfate were contained and stirred at a revolution of 400 rpm for 15 minutes. Thus, a white emulsion was obtained. The white emulsion was heated to 75° C. and subjected to a reaction for 5 hours. A 1% aqueous solution of ammonium persulfate in an amount of 30 parts was further added to the emulsion, and the mixture was aged at 75° C. for 5 hours. Thus, a fine particle dispersion liquid 1 was prepared, that was an aqueous dispersion of a vinyl resin (i.e., a copolymer of styrene, methacrylic acid, and a sodium salt of a sulfate of ethylene oxide adduct of methacrylic acid).

The fine particles in the fine particle dispersion liquid 1 had a volume average particle diameter of 0.14 μm when measured by an instrument LA-920 (available from HORIBA, Ltd.).

A part of the fine particle dispersion liquid 1 was dried to isolate the resin.

Preparation of Aqueous Phase

An aqueous phase 1 was prepared by stir-mixing 990 parts of water, 83 parts of the fine particle dispersion liquid 1, 37 parts of a 48.5% aqueous solution of sodium dodecyl diphenyl ether disulfonate (ELEMINOL MON-7 available from Sanyo Chemical Industries, Ltd.), and 90 parts of ethyl acetate. The aqueous phase 1 was a milky white liquid.

Emulsification and Solvent Removal

In the vessel containing the oil phase 1, 1,200 parts of the aqueous phase 1 was added and mixed with a TK HOMOMIXER at a revolution of 13,000 rpm for 20 minutes. Thus, an emulsion slurry 1 was prepared. The emulsion slurry 1 was contained in a vessel equipped with a stirrer and a thermometer and subjected to solvent removal at 30° C. for 8 hours and subsequently to aging at 45° C. for 4 hours. Thus, a dispersion slurry 1 was obtained.

Washing and Drying

After 100 parts of the dispersion slurry 1 was filtered under reduced pressures, the following operations were carried out.

(1) The filter cake was mixed with 100 parts of ion-exchange water using a TK HOMOMIXER at a revolution of 12,000 rpm for 10 minutes and thereafter filtered.

(2) 100 parts of a 10% aqueous solution of sodium hydroxide was added to the filter cake of (1) and mixed therewith using a TK HOMOMIXER at a revolution of 12,000 rpm for 30 minutes, followed by filtration under reduced pressures.

(3) 100 parts of a 10% aqueous solution of hydrochloric was added to the filter cake of (2) and mixed therewith using a TK HOMOMIXER at a revolution of 12,000 rpm for 10 minutes, followed by filtration.

(4) 300 parts of ion-exchange water was added to the filter cake of (3) and mixed therewith using a TK HOMOMIXER at a revolution of 12,000 rpm for 10 minutes, followed by filtration. These operations (1) to (4) were repeated twice, thus obtaining a filter cake.

The filter cake was dried by a circulating air dryer at 45° C. for 48 hours and then filtered with a mesh having an opening of 75 μm. Thus, a mother toner particle 1 was prepared.

External Addition Treatment

Next, 100 parts of the mother toner particle 1 was mixed with 0.6 parts of a hydrophobic silica having an average particle diameter of 100 nm, 1.0 part of a titanium oxide having an average particle diameter of 20 nm, and 0.8 parts of a hydrophobic silica powder having an average particle diameter of 15 nm using a 20-L HENSCHEL MIXER (manufactured by Mitsui Mining and Smelting Co., Ltd.) at a revolution of 50 m/s for 5 minutes while cooling the inside of a mixing chamber by allowing 30% ethylene glycol water having a temperature of −5° C. to flow into a jacket. The resulting mixture was sieved with a 500-mesh sieve. Thus, a toner 1 was prepared. $P_{2850}/P_{828}$ of the toner 1 was 0.10.

Preparation of Carrier

A resin layer coating liquid was prepared by dispersing 100 parts by mass of a silicone resin (organo straight silicone), 5 parts by mass of γ-(2-aminoethyl) aminopropyl trimethoxysilane, and 10 parts by mass of a carbon black in 100 parts by mass of toluene by a homomixer for 20 minutes. The resin layer coating liquid was applied to the surfaces of 1,000 parts of spherical magnetite having an average particle diameter of 50 μm by a fluidized bed coating device. Thus, a carrier was prepared.

Preparation of Developer

The toner 1 in an amount of 5 parts by mass and the carrier in an amount of 95 parts by mass were mixed using a ball mill. Thus, a developer was prepared.

Production Example 2

Preparation of Toner 2

The procedure in "Preparation of Wax Dispersion Liquid" in Production Example 1 was repeated except for changing the number of times of the dispersing operations to 1 pass. Thus, a wax dispersion liquid 2 was prepared.

The procedure in Production Example 1 was repeated except for replacing the wax dispersion liquid 1 with the wax dispersion liquid 2. Thus, a toner 2 was prepared. $P_{2850}/P_{828}$ of the toner 2 was 0.14.

Production Example 3

Preparation of Toner 3

The procedure in "Preparation of Wax Dispersion Liquid" in Production Example 1 was repeated except for changing the number of times of the dispersing operations to 5 passes. Thus, a wax dispersion liquid 3 was prepared.

The procedure in Production Example 1 was repeated except for replacing the wax dispersion liquid 1 with the wax dispersion liquid 3. Thus, a toner 3 was prepared. $P_{2850}/P_{828}$ of the toner 3 was 0.05.

Production Example 4

Preparation of Toner 4

The procedure in Production Example 1 was repeated except for replacing the prepolymer A-1 and the polyester resin C-1 with the prepolymer A-2 and the polyester resin C-2, respectively. Thus, a mother toner particle 4 was prepared. A toner 4 was prepared using the mother toner particle 4. $P_{2850}/P_{828}$ of the toner 4 was 0.10.

Production Example 5

Preparation of Toner 5

The procedure in Production Example 1 was repeated except for replacing the prepolymer A-1 with 152 parts of the prepolymer A-2 and replacing the polyester resin C-1 with 760 parts of the polyester resin C-2. Thus, a mother toner particle 5 was prepared. A toner 5 was prepared using the mother toner particle 5. $P_{2850}/P_{828}$ of the toner 5 was 0.11.

Production Example 6

Preparation of Toner 6

The procedure in Production Example 1 was repeated except for replacing the oil phase 1 with an oil phase 6 that was prepared by mixing 500 parts of the wax dispersion liquid 1, 152 parts of the prepolymer A-2, 251 parts of the prepolymer B-2, 836 parts of the amorphous polyester resin C-1, 100 parts of the master batch 1, and 2 parts of the ketimine compound 1 as a curing agent in a vessel with a TK HOMOMIXER (available from PRIMIX Corporation) at a revolution of 7,000 rpm for 60 minutes. Thus, a mother toner particle 6 was prepared. A toner 6 was prepared using the mother toner particle 6. $P_{2850}/P_{828}$ of the toner 6 was 0.10.

Production Example 7

Preparation of Toner 7

The procedure in Production Example 1 was repeated except for replacing the oil phase 1 with an oil phase 7 that was prepared by mixing 500 parts of the wax dispersion liquid 1, 34 parts of the prepolymer A-2, 534 parts of the prepolymer B-2, 836 parts of the amorphous polyester resin C-1, 100 parts of the master batch 1, and 2 parts of the ketimine compound 1 as a curing agent in a vessel with a TK HOMOMIXER (available from PRIMIX Corporation) at a revolution of 7,000 rpm for 60 minutes. Thus, a mother toner particle 7 was prepared. A toner 7 was prepared using the mother toner particle 7. $P_{2850}/P_{828}$ of the toner 7 was 0.10.

Production Example 8

Preparation of Toner 8

The procedure in Production Example 1 was repeated except for replacing the prepolymer A-1 with 19 parts of the prepolymer A-3, replacing the prepolymer B-1 with 226 parts of the prepolymer B-3, and replacing the polyester resin C-1 with 779 parts of the polyester resin C-3. Thus, a mother toner particle 8 was prepared. A toner 8 was prepared using the mother toner particle 8. P2850/P828 of the toner 8 was 0.09.

Production Example 9

Preparation of Toner 9

The procedure in Production Example 1 was repeated except for replacing the polyester resin C-1 with the polyester resin C-4. Thus, a mother toner particle 9 was prepared. A toner 9 was prepared using the mother toner particle 9. $P_{2850}/P_{828}$ of the toner 9 was 0.12.

Production Example 10

Preparation of Toner 10

The procedure in Production Example 1 was repeated except for changing the amount of the prepolymer B-1 to 0 part (i.e., the prepolymer B-1 was not used). Thus, a mother toner particle 10 was prepared. A toner 10 was prepared using the mother toner particle 10. $P_{2850}/P_{828}$ of the toner 10 was 0.10.

Production Example 11

Preparation of Toner 11

The procedure in Production Example 1 was repeated except for changing the amount of the prepolymer A-1 to 0 part (i.e., the prepolymer A-1 was not used). Thus, a mother toner particle 11 was prepared. A toner 11 was prepared using the mother toner particle 11. P2850/P828 of the toner 11 was 0.10.

Production Example 12

Preparation of Toner 12

The procedure in "Preparation of Oil Phase" in Production Example 2 was repeated except for changing the revolution and the mixing time by the TK HOMOMIXER (available from PRIMIX Corporation) to 5,000 rpm and 60 minutes, respectively. Thus, an oil phase 12 was prepared. The procedure in Production Example 2 was repeated except for replacing the oil phase 2 with the oil phase 12. Thus, a toner 12 was prepared. $P_{2850}/P_{828}$ of the toner 12 was 0.19.

Production Example 13

Preparation of Toner 13

The procedure in "Preparation of Oil Phase" in Production Example 3 was repeated except for changing the addition amount of the wax dispersion liquid 3 to 250 parts. Thus, an oil phase 13 was prepared. Further, the procedure in "Emulsification and Solvent Removal" in Production Example 3 was repeated except that the mixing by the TK HOMOMIXER was performed at a revolution of 15,000 rpm for 30 minutes while being cooled with cooling water having a temperature of 10° C. Thus, a toner 13 was prepared. $P_{2850}/P_{828}$ of the toner 13 was 0.03.

Production Example 14

Preparation of Toner 14

The procedure in "Preparation of Oil Phase" in Production Example 12 was repeated except for changing the revolution and the mixing time by the TK HOMOMIXER (available from PRIMIX Corporation) to 5,000 rpm and 20 minutes, respectively. Thus, an oil phase 14 was prepared.

The procedure in Production Example 12 was repeated except for replacing the oil phase 12 with the oil phase 14. Thus, a toner 14 was prepared. $P_{2850}/P_{828}$ of the toner 14 was 0.22.

Production Example 15

Preparation of Toner 15

The procedure in "Preparation of Oil Phase" in Production Example 1 was repeated except for changing the amount of the wax dispersion liquid 1 to 0 part (i.e., the wax dispersion liquid 1 was not used). Thus, an oil phase 15 was prepared.

The procedure in Production Example 1 was repeated except for replacing the oil phase 1 with the oil phase 15. Thus, a toner 15 was prepared. $P_{2850}/P_{828}$ of the toner 15 was 0.

Production Example 16

Preparation of Toner 16

The procedure in Production Example 1 was repeated except for replacing the oil phase 1 with an oil phase 16 that was prepared by mixing 500 parts of the wax dispersion liquid 1, 76 parts of the prepolymer A-1, 152 parts of the prepolymer B-1, 836 parts of the amorphous polyester resin C-1, 300 parts of the crystalline polyester resin dispersion liquid 1, 100 parts of the master batch 1, and 2 parts of the ketimine compound 1 as a curing agent in a vessel with a TK HOMOMIXER (available from PRIMIX Corporation) at a revolution of 6,000 rpm for 60 minutes. Thus, a mother toner particle 16 was prepared. A toner 16 was prepared using the mother toner particle 16. $P_{2850}/P_{828}$ of the toner 16 was 0.14.

Production Example 17

Preparation of Toner 17

The procedure in Production Example 1 was repeated except for replacing the oil phase 1 with an oil phase 17 that was prepared by mixing 500 parts of the wax dispersion liquid 1, 76 parts of the prepolymer A-1, 152 parts of the prepolymer B-1, 836 parts of the amorphous polyester resin C-1, 171 parts of the crystalline polyester resin dispersion liquid 1, 100 parts of the master batch 1, and 2 parts of the ketimine compound 1 as a curing agent in a vessel with a TK HOMOMIXER (available from PRIMIX Corporation) at a revolution of 6,000 rpm for 60 minutes. Thus, a mother toner particle 17 was prepared. A toner 17 was prepared using the mother toner particle 17. P2850/P828 of the toner 17 was 0.13.

Measurements $Tg_{1st}$ of Toner and Glass Transition Temperatures of Polyester Resin Components A, B, and C First, 1 g of the toner was put in 100 mL of THF and subjected to Soxhlet extraction to obtain THF-soluble matter and THF-insoluble matter. The THF-soluble matter and the THF-insoluble matter were dried in a vacuum dryer for 24 hours, thus obtaining a mixture of the polyester resin component C and the crystalline polyester resin component D from the THE soluble matter and a mixture of the polyester resin component A and the polyester resin component B from the THE-insoluble matter. The mixtures thus obtained were treated as target samples for measuring glass transition temperatures thereof. Also, the toner was treated as a target sample for measuring $Tg_{1st}$ of the toner.

Next, about 5.0 mg of each target sample was put in an aluminum sample container. The sample container was put on a holder unit and set in an electric furnace. The temperature was raised from −80° C. to 150° C. at a temperature rising rate of 10° C./min ("first heating") in nitrogen atmosphere. The temperature was thereafter lowered from 150° C. to −80° C. at a temperature falling rate of 10° C./min and raised to 150° C. again at a temperature rising rate of 10° C./min ("second heating"). In each of the first heating and the second heating, a DSC curve was obtained by a differential scanning calorimeter (Q-200 available from TA Instruments).

The obtained DSC curves were analyzed with analysis program installed in Q-200. By selecting the DSC curve obtained in the first heating, a glass transition temperature $Tg_{1st}$ of the target sample in the first heating was determined. Similarly, by selecting the DSC curve obtained in the second heating, a glass transition temperature $Tg_{2nd}$ of the target sample in the second heating was determined.

Mass Ratio of Polyester Resin Components A, B, C, and D

The mass ratio between the polyester resin component C and the crystalline polyester resin D was determined from the THF-soluble matter obtained by Soxhlet extraction, and the constitutional ratio between the polyester resin component C and the crystalline polyester resin D was determined. The mass ratio between the polyester resin components A and B was determined from the THF-insoluble matter obtained by Soxhlet extraction, and the constitutional ratio between the polyester resin components A and B was determined.

Examples 1 to 15 and Comparative Examples 1 and 2

Unfixed images were formed by a tandem full-color copier RICOH PRO C5210 (manufactured by Ricoh Co., Ltd.), equipped with four non-magnetic two-component developing units and four photoconductors, with each of the toners 1 to 17 (see Table 1). The unfixed images were allowed to pass through the fixing nip in a test machine in which only the fixing device operates, and the degrees of fixing releasability and glossy residual image were evaluated. The printing speed was set high (i.e., 80 sheets/minute/A4), and the fixing device was driven by a fixing roller driving system.

Comparative Example 3

The procedure in Example 1 was repeated except for driving the fixing device by a pressure roller driving system. The degrees of fixing releasability and glossy residual image were evaluated in the same manner as in Example 1.

Fixing Releasability

A solid image having a toner deposition amount of 0.91±0.5 mg/cm$^2$ was formed on three sheets of plain paper (copy printing paper <45> available from Ricoh Co., Ltd.) with the margin at the leading edge of each sheet being minimum. The degree of fixing releasability was evaluated and ranked into the following three levels: rank A when all the three sheets were able to pass through the fixing nip without winding around the fixing belt; rank B when one of the three sheets were wound around the fixing belt; and rank C when two or more of the three sheets were wound around the fixing belt. Fixing releasability was evaluated in a temperature range within which a sheet having a toner image thereon is allowed to pass through the fixing nip of the fixing device.

Glossy Residual Image

Figure 8A:
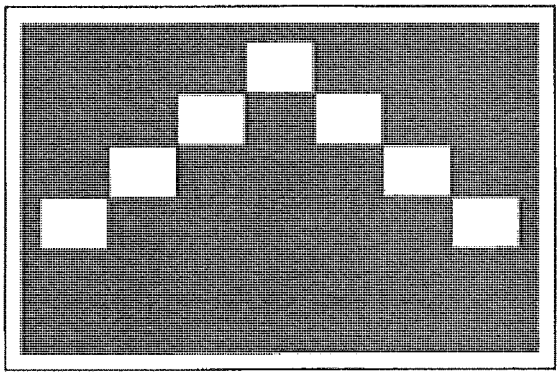
FIGS. 8A and 8B are diagrams illustrating a residual image chart and a detection chart, respectively, used for evaluating glossy residual image.
Figure 8B:
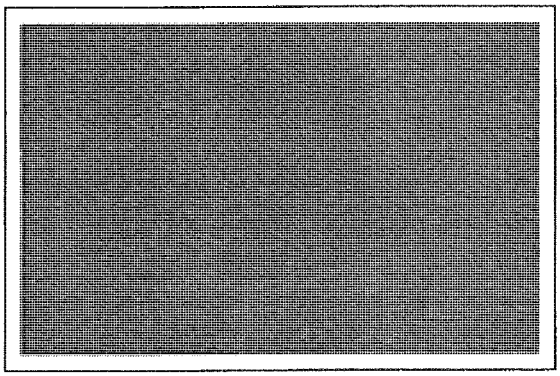

A residual image chart (illustrated in FIG. 8A) including a solid image with blank portions and a detection chart (illustrated in FIG. 8B) including a solid image with no blank portion were formed on respective sheets of gloss coated paper (OK SPECIAL ART POST 279 gsm available from Oji Materia Co., Ltd.). The sheets were adhered to each other with a piece of tape and allowed to pass through the fixing nip of a test machine. When a glossy residual image remarkably occurs, the pattern of the blank portions of the residual image chart having a low glossiness appears in the solid image portion of the detection chart having a high glossiness. The level of the glossy residual image was evaluated by the difference (in absolute value) in gloss value between the pattern of the blank portions of the residual image chart appearing on the detection chart and the solid image portion of the detection chart and ranked as follows: rank A+ when the difference was less than 5; rank A when the difference was 5 or more and less than 10; rank B when the difference was 10 or more and less than 15; and rank C when the difference was 15 or more. Glossy residual image was evaluated in a temperature range within which a sheet having a toner image thereon is allowed to pass through the fixing nip of the fixing device.

The evaluation results for the degrees of fixing releasability and glossy residual image in Examples 1 to 15 and Comparative Examples 1 to 3 are presented in Table 1.

TABLE 1

| | Driving System of Fixing Device | Toner | | | | | | | Glossy | |
|---|---|---|---|---|---|---|---|---|---|---|
| | | | | | THF-soluble Matter | THF insoluble Matter | | | | |
| | | Type | $P_{2850}/P_{828}$ | $Tg_{1st}$ [° C.] | $Tg_{2nd}$ [° C.] | $Tg_{a1st}$ [° C.] | $Tg_{b1st}$ [° C.] | $Tg_{2nd}$ [° C.] | Residual Image | Fixing Releasability |
| Example 1 | Fixing Roller Driving | 1 | 0.1 | 57 | 51 | −37 | 56 | 10 | A+ | A |
| Example 2 | Fixing Roller Driving | 2 | 0.14 | 56 | 51 | −36 | 55 | 9 | A+ | A |
| Example 3 | Fixing Roller Driving | 3 | 0.05 | 56 | 51 | −36 | 57 | 10 | A+ | A |
| Example 4 | Fixing Roller Driving | 4 | 0.1 | 47 | 42 | −45 | 57 | 6 | A+ | A |
| Example 5 | Fixing Roller Driving | 5 | 0.11 | 47 | 42 | 3 | 57 | 29 | A+ | A |
| Example 6 | Fixing Roller Driving | 6 | 0.1 | 49 | 44 | −45 | 57 | 30 | A+ | A |
| Example 7 | Fixing Roller Driving | 7 | 0.1 | 53 | 45 | −45 | 48 | −2 | A+ | A |
| Example 8 | Fixing Roller Driving | 8 | 0.09 | 65 | 56 | 0 | 68 | 53 | A+ | A |
| Example 9 | Fixing Roller Driving | 9 | 0.12 | 44 | 40 | −37 | 57 | 10 | A+ | A |
| Example 10 | Fixing Roller Driving | 10 | 0.1 | 69 | 62 | −37 | — | −40 | A+ | A |
| Example 11 | Fixing Roller Driving | 11 | 0.11 | 62 | 55 | — | 57 | 55 | A+ | A |
| Example 12 | Fixing Roller Driving | 12 | 0.19 | 57 | 51 | −37 | 57 | 10 | A | A |
| Example 13 | Fixing Roller Driving | 13 | 0.03 | 55 | 50 | −35 | 55 | 9 | A+ | B |
| Comparative Example 1 | Fixing Roller Driving | 14 | 0.22 | 58 | 52 | −38 | 58 | 10 | C | A |
| Comparative Example 2 | Fixing Roller Driving | 15 | 0 | 57 | 51 | −36 | 66 | 10 | A+ | C |
| Example 14 | Fixing Roller Driving | 16 | 0.14 | 57 | 52 | −37 | 57 | 10 | A+ | A |
| Example 15 | Fixing Roller Driving | 17 | 0.13 | 57 | 53 | −37 | 57 | 10 | A+ | A |
| Comparative Example 3 | Pressure Roller Driving | 1 | 0.1 | 57 | 51 | −37 | 56 | 10 | B | A |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A fixing method comprising:

fixing a toner on a recording medium with a fixing device, wherein the toner comprises a binder resin, a colorant, and a release agent, wherein the toner has a release agent amount indicator of from 0.01 to 0.20, the release agent amount indicator represented by a ratio ($P_{2850}/P_{828}$) of an intensity ($P_{2850}$) at a wave number of 2,850 $cm^{-1}$ to an intensity ($P_{828}$) at a wave number of 828 $cm^{-1}$ of the toner measured by a Fourier transform infrared spectroscopy attenuated total reflection method, wherein the fixing device includes:

a fixing rotator driven to rotate by a driving source;

a pressure rotator driven to rotate by rotation of the fixing rotator;

a fixing belt interposed between the fixing rotator and the pressure rotator; and a heater to heat the fixing belt.

2. The fixing method of claim 1, further comprising:

increasing a pressing force between the fixing rotator and the pressure rotator as a thickness of the recording medium becomes smaller.

3. The fixing method of claim 1, wherein the toner has a glass transition temperature ($Tg_{1st}$) of from 45° C. to 65° C. measured in a first temperature rising in a differential scanning calorimetry, wherein a THF-insoluble matter in the toner has two glass transition temperatures $Tg_{a1st}$ of from −45° C. to 5° C. and $Tg_{a1st}$ of from 45° C. to 70° C. measured in the first temperature rising in the differential scanning calorimetry, wherein a THF-soluble matter in the toner has a glass transition temperature ($Tg_{2nd}$) of from 40° C. to 65° C. measured in a second temperature rising in the differential scanning calorimetry.

4. The fixing method of claim 3, wherein the THF-insoluble matter in the toner has a glass transition temperature ($Tg_{2nd}$) of from 0° C. to 50° C. measured in the second temperature rising in the differential scanning calorimetry.

5. An image forming method comprising:

forming an image with a toner; and fixing the image on a recording medium with a fixing device, wherein the toner comprises a binder resin, a colorant, and a release agent, wherein the toner has a release agent amount indicator of from 0.01 to 0.20, the release agent amount indicator represented by a ratio ($P_{2850}/P_{828}$) of an intensity ($P_{2850}$) at a wave number of 2,850 $cm^{-1}$ to an intensity ($P_{828}$) at a wave number of 828 $cm^{-1}$ of the toner measured by a Fourier transform infrared spectroscopy attenuated total reflection method, wherein the fixing device includes:

a fixing rotator driven to rotate by a driving source;

a pressure rotator driven to rotate by rotation of the fixing rotator;

a fixing belt interposed between the fixing rotator and the pressure rotator; and a heater to heat the fixing belt.

6. The image forming method of claim 5, further comprising:

reducing a driving speed of the fixing rotator when an image area ratio of the image formed latest is equal to or more than a predetermined value.

7. The image forming method of claim 5, further comprising:

reducing a pressing force between the fixing rotator and the pressure rotator when an image area ratio of the image formed latest is equal to or more than a predetermined value.

8. An image forming apparatus comprising:

an electrostatic latent image bearer;

a charger to charge a surface of the electrostatic latent image bearer;

an irradiator to irradiate the charged surface of the electrostatic latent image bearer to form an electrostatic latent image;

a developing device containing a toner, to develop the electrostatic latent image with the toner to form a toner image;

a transfer device to transfer the toner image onto a recording medium; and a fixing device to fix the toner image on the recording medium, including:

a fixing rotator driven to rotate by a driving source;

a pressure rotator driven to rotate by rotation of the fixing rotator;

a fixing belt interposed between the fixing rotator and the pressure rotator; and a heater to heat the fixing belt, wherein the toner has a release agent amount indicator of from 0.01 to 0.20, the release agent amount indicator represented by a ratio ($P_{2850}/P_{828}$) of an intensity ($P_{2850}$) at a wave number of 2,850 $cm^{-1}$ to an intensity ($P_{828}$) at a wave number of 828 $cm^{-1}$ of the toner measured by a Fourier transform infrared spectroscopy attenuated total reflection method.

9. The image forming apparatus of claim 8, wherein the toner has a glass transition temperature ($Tg_{1st}$) of from 45° C. to 65° C. measured in a first temperature rising in a differential scanning calorimetry, wherein a THF-insoluble matter in the toner has two glass transition temperatures $Tg_{a1st}$ of from −45° C. to 5° C. and $Tg_{b1st}$ of from 45° C. to 70° C. measured in the first temperature rising in the differential scanning calorimetry, wherein a THF-soluble matter in the toner has a glass transition temperature ($Tg_{2nd}$) of from 40° C. to 65° C. measured in a second temperature rising in the differential scanning calorimetry.

10. The image forming apparatus of claim 9, wherein the THF-insoluble matter in the toner has a glass transition temperature ($Tg_{2nd'}$) of from 0° C. to 50° C. measured in the second temperature rising in the differential scanning calorimetry.

* * * * *